US005700490A

United States Patent [19]

Meise

[11] Patent Number: 5,700,490

[45] Date of Patent: Dec. 23, 1997

[54] APPARATUS AND METHOD FOR THE THERMAL TREATMENT OF FIBERS

[75] Inventor: Hansjorg Meise, Cologne, Germany

[73] Assignee: Barmag AG, Remscheid, Germany

[21] Appl. No.: 534,950

[22] Filed: Sep. 28, 1995

[30] Foreign Application Priority Data

| | | | |
|---|---|---|---|
| Sep. 30, 1994 | [DE] | Germany | 44 35 152.6 |
| Mar. 17, 1995 | [DE] | Germany | 195 09 842.0 |
| Apr. 3, 1995 | [DE] | Germany | 195 12 433.2 |

[51] Int. Cl.[6] ..... B29C 47/88

[52] U.S. Cl. ..... 425/72.2; 264/168; 264/176.1; 264/210.8; 264/211.14

[58] Field of Search ..... 425/72.2; 264/103, 264/168, 211.14, 210.8, 176.1

[56] References Cited

U.S. PATENT DOCUMENTS

| | | | |
|---|---|---|---|
| 2,273,105 | 2/1942 | Heckert | 425/72.2 |
| 3,053,611 | 9/1962 | Griehl | 264/210.8 |
| 3,274,644 | 9/1966 | Massey et al. | 425/72.2 |
| 3,325,906 | 6/1967 | Franke | 264/211.14 |
| 3,436,792 | 4/1969 | Hench | 425/72.2 |
| 3,447,202 | 6/1969 | Kato | 425/72.2 |
| 3,460,200 | 8/1969 | Zaitsev et al. | 425/72.2 |
| 3,492,691 | 2/1970 | Carr | 264/211.14 |
| 3,512,214 | 5/1970 | Subia et al. | 425/72.2 |
| 3,517,412 | 6/1970 | Swanson et al. | 425/72.2 |
| 3,936,253 | 2/1976 | Fisher et al. | 425/72.2 |
| 4,743,186 | 5/1988 | Schippers | 425/72.2 |
| 4,943,220 | 7/1990 | Fourne | 264/211.14 |
| 5,059,104 | 10/1991 | Alberto . | |
| 5,173,310 | 12/1992 | Katou et al. | 425/72.2 |
| 5,178,814 | 1/1993 | Lemond | 425/72.2 |
| 5,234,327 | 8/1993 | Martin | 425/72.2 |
| 5,433,591 | 7/1995 | Zingsem et al. | 425/72.2 |

FOREIGN PATENT DOCUMENTS

| | | | |
|---|---|---|---|
| 502829 | 8/1952 | Belgium | 425/72.2 |
| 580 977 | 2/1994 | European Pat. Off. . | |
| 19 14 556 | 3/1970 | Germany . | |
| 19 05 507 | 8/1970 | Germany . | |
| 22 47 718 | 4/1974 | Germany . | |
| 22 54 998 | 7/1975 | Germany . | |
| 34 06 347 | 10/1984 | Germany . | |
| 3612610 | 10/1987 | Germany | 425/72.2 |
| 4014413A | 11/1991 | Germany | 425/72.2 |
| 34 24 253 | 8/1992 | Germany . | |
| 45-28726 | 9/1970 | Japan | 425/72.2 |

OTHER PUBLICATIONS

Heinz Schätzle, "Spinnstrecken–Schnellspinnen– Strecktexturieren", International Textiel Bulletin ITB; Apr., 1973, pp. 373–380.

*Primary Examiner*—Jay H. Woo
*Assistant Examiner*—Minh-Chau T. Pham
*Attorney, Agent, or Firm*—Bell, Seltzer, Park & Gibson, P.A.

[57] ABSTRACT

The invention relates to a cooling assembly for a fiber spinning machine, which forms a cooling zone for the fibers and has openings, through which a cooling fluid flows to the fibers. The cooling assembly is formed by a plurality of overlying annular elements. Arranged between the elements are spacers so as to permit air to flow between the elements into the cooling assembly.

23 Claims, 18 Drawing Sheets

77
77
76

Elongation at Break [%] as a Function of the Withdrawal Speed $\left( \frac{l_{Br}-l}{l} \cdot 100 \right)$ Elongation at Break [%] as a Function of the Withdrawal Speed $\left( \frac{l_{Br}-l}{l} \cdot 100 \right)$ Yarn Denier (Denier per Filament)

Withdrawal Speed (m/min)

| | 0.3 | 0.5 | 1 | 2 | 4 |
|---|---|---|---|---|---|
| 2000 | 132 % | 155 % | | | |
| 2500 | 103 % | 122 % | 142 % | 153 % | |
| 3000 | 81 % | 96 % | 114 % | 121 % | 138 % |
| 3500 | 70 % | 78 % | 91 % | 97 % | 110 % |
| 4000 | 63 % | 69 % | 76 % | 80 % | 90 % |
| 4500 | 56 % | 61 % | 67 % | 70 % | 76 % |
| 5000 | 50 % | 54 % | 60 % | 63 % | 67 % |
| 5500 | 45 % | 48 % | 52 % | 56 % | 59 % |
| 6000 | 40 % | 43 % | 48 % | 49 % | 52 % |

Fig.24

APPARATUS AND METHOD FOR THE THERMAL TREATMENT OF FIBERS

FIELD OF THE INVENTION

The present invention relates to a melt spinning apparatus for extruding and spinning synthetic polymeric filaments and the like. The melt spinning apparatus comprises a cooling assembly for cooling the filament during the extrusion and spinning processes.

BACKGROUND OF THE INVENTION

Prior art cooling means are disclosed in EP 93 108 161 and U.S. Pat. Nos. 5,059,104 and 4,743,186. The cooling means in each of these patents are in the form of a tubular cooler arranged vertically below a spinneret.

For example, in the spinning machine described in EP 93 108 161, the fibers exiting from the spinnerets advance through a tubular cooler or cooling assembly before they are combined to a yarn. The speed of the fibers generates a vacuum in the tubular cooler. The pressure difference between the interior of the tubular cooler and the atmosphere causes ambient air to flow into the tubular cooler through its porous or perforated wall.

In the spinning machine disclosed in U.S. Pat. No. 5,059,109, the tubular cooler is also arranged below the spinneret. The holes of the spinneret are distributed over a circle. The tubular cooler is arranged such that the fibers emerging from the nozzles surround the tubular cooler. The cooling air exits radially from different segments of the tubular cooler.

The cooling effect that is necessary for the spinning of synthetic fibers depends in particular on the number and the mass of the fibers, the thickness of the individual fibers, the speed of the fibers, and other factors. It is therefore necessary to adapt the tubular cooler with respect to cooling length and quantity of cooling gas to the particular production conditions.

SUMMARY OF THE INVENTION

It is therefore an object of the invention to solve the above problem of designing and constructing a cooling assembly or tubular cooler such that it can easily be adapted to the different treatment requirements.

The above and other objects and advantages of the present invention are achieved by the provision of a cooling assembly which is adapted to be arranged in a spinning machine vertically downstream of the spinneret of the spinning machine. The cooling assembly comprises radially directed openings for permitting cooling gas to enter the system. The walls of the cooling assembly are annular, formed by superposed annular elements overlying one another to define a spacing therebetween and to define the radially directed openings in the form of annular gas channels.

The geometry of the gas channels of the cooling assembly is dependent on the geometry of the annular elements forming the channels, their relative spacings, as well as the number of elements. A corresponding configuration of the elements allows the inflowing fluid to adapt with the flow rate, type and direction of flow. The apparatus may be constructed of a plurality of differently designed elements. The flow conditions of the fluid may be varied over the treatment zone.

The cooling assembly of the present invention consists of annular or toroidal elements. These annular elements are essentially of the same size. This means that the annular elements form the wall of a tubular cooler in that they are axially arranged one after the other. The elements are spaced apart from each other, so that an annular gap (gas channel) forms between two adjacent elements. The ring shape of this gas channel may be interrupted by spacers placed between individual, adjacent elements. The length of this tubular cooler is defined by the number and the axial thickness of the elements, as well as by the spacing between adjacent elements. The quantity of air that can be supplied to the filaments depends in particular on the number of elements and the spacing between adjacent elements.

In general, the spinneret holes for the filaments are distributed in a certain pattern evenly over a circular surface. Therefore, symmetrical cooling conditions within such a fiber bundle result.

The tubular cooler of the present invention permits various geometries of gas channels. Thus, it is possible to cause the radial air flow to impact upon the fiber bundle substantially perpendicularly and without a conveyance effect. In another embodiment, each annular air flow causes the heated air jacket entrained by the fibers to be stripped off and replaced with fresh cooling air. In this process, the annular cooling air flow may also be used to increase the tension that is exerted on the fibers or, however, to advance the fibers.

The apparatus according to an embodiment of the present invention influences the flow Conditions of each individual cooling gas flow that is supplied. As a result of the convex shape of the boundary surfaces of adjacent elements, the gas channel can be constructed, when viewed in the axial section of the tubular cooler, in the form of a nozzle, for example, in the manner of a Laval nozzle. Thus, a very uniform flow of cooling gas with small pressure differences results from the configuration of the present invention. This configuration is referred to as a so-called "self-aspirating tubular cooler".

The cooling gas may be atmospheric air, i.e. the ambient air of the spinning plant. It is possible to control the quantity of the cooling gas and to adapt it to the requirements by predetermining a certain external pressure. In this arrangement, only the first and last elements are fitted in substantially airtight manner into the upper side and underside of the pressure container, whereas all remaining intermediate elements are stacked with a spacing between each other.

Likewise this arrangement permits the intermediate elements to be exchanged without notably revamping the pressure container for adaptation to the existing cooling function.

As previously described, the tubular cooler enables in particular a spinning and cooling, in which freshly spun fibers entrain so much air that a vacuum is generated in the tubular cooler, thereby producing a constant flow of cooling air from the outside to the inside. In this process, the fibers are withdrawn from the spinneret preferably at a speed of more than 3,500 meters per minute. In a preferred embodiment, this withdrawal speed is or exceeds 5,000 meters per minute. In this instance, the tubular cooler is surrounded by atmospheric air. As disclosed in the case the known spinning machine, the tubular cooler can also be arranged in a vacuum box, the vacuum being generated in that the supply of ambient air can be controlled and adapted to the desired need.

As initially described, it is also possible to further develop the tubular cooler disclosed in U.S. Pat. No. 5,059,104 and incorporated herein by reference. In the cooling principle disclosed therein, cooling occurs substantially by the air current impacting radially upon the fibers and only to a secondary extent by entrained air. Consequently, the control of the several air currents of the shape of a disk or a cone is of particular importance for an optimal course of the temperature gradient in the freshly spun fibers. As a result, the high flexibility of the tubular cooler of the present invention makes same very suitable especially for this cooling principle.

The spacing between the elements can be realized in that the elements are secured to or mounted in a holder. The dimensioning of the gas channels is especially easy to realize by means of spacers. These spacers may be individual parts, which are placed between adjacent elements. However, it is also possible to make such spacers integral parts of adjacent boundary surfaces of the elements.

For a greater flexibility with respect to the number of elements and the width of the gas channels use is made of axial guideways. Such axial guideways may include, for example, two or more bars, which are aligned axis parallel to the axis of the tubular cooler. In this instance, each element is provided with guide sleeves, guide holes, or guide shells, through which it is lined up on the bars for sliding therealong. Clamping screws, for example, permit the individual element to be secured to the bar at a predetermined distance from the adjacent element.

In its standard design, the tubular cooler of the present invention is made cylindrical, and preferably circular cylindrical. This applies both to its outer circumference and its inner circumference. A deviation from this standard design allows to influence again the flow and cooling conditions in the tubular cooler. This may occur in a further development of the tubular cooler of the present invention simply in that similar elements with different cross sections are used and even subsequently installed in the spinning machine. In one embodiment the cross section of the passageway widens in the direction of spinning. As a result, an increasing vacuum develops in the tubular cooler with the consequence that an increasing amount of cooling gas is sucked in.

In particular, for generating a very smooth advance of the fibers, which is favorable for the yarn quality, the cooling air is guided turbulencefree through the openings into the interior of the tubular cooler.

The supply of the cooling fluid may occur as a result of the suction effect that is generated in the tubular cooler. It is also possible, as previously proposed, to supply the air to the tubular cooler by means of a blower.

The combination of suitable elements permits the cross section in the opening for the cooling fluid to be configured such that the cross section narrows toward the interior of the tubular cooler. This allows to influence the speed and the manner of the cooling air flow, so that certain turbulent flow conditions can be generated in the interior of the tubular cooler. In addition, the forced turbulences cause in the flow of the cooling fluid pressure differences, which suck in additional air.

The spacers form an obstacle in the flow of the cooling air. To eliminate the influence of the spacers on the cooling of the fibers, it is preferred to arrange the spacers offset from one another. The offset arrangement results in that the fibers are subject to an interruption in the flow only temporarily and in different places. Furthermore, it is desirable that the spacers have a fluid-dynamically favorable cross section.

The design of the tubular cooler in accordance with the invention has also the advantage that its manufacture is considerably simplified and reduced in cost, since porous or perforated tubes are no longer used for the cooler, and tubes constructed of elements are used instead.

The spacers may also be used to hold the elements. They may likewise form an integral part of an element.

Besides the variation of the flow conditions of the cooling gas, it is also possible to vary the temperature of the cooling gas. It may be useful, to let the fluid enter into the treatment zone at an increased temperature in the region of the inlet cross section. This measure allows to reduce the heat losses at the spinneret. At the same time, it is ensured that the fiber material does not undergo a crystallization. Thereafter, the temperature of the fluid decreases in the direction of the treatment zone. The decrease may be continuous or sudden. In the following, the terms cooling air and tubular cooler are used synonymously for the fluid and the apparatus for the thermal treatment. To heat the cooling gas, one or several adjacent elements may be heated. It has been found that production can be increased according to Application 1 95 04 422.3 which is incorporated herein by reference (and publications resulting therefrom).

It has been found that there exists a physical dependence between the withdrawal speed and the draw ratio that can still be realized thereafter. This interdependence occurs as a result of a partial orientation of the molecule chains that is realized by the high withdrawal speed which is in this instance more than 2,000 meters per minute. As a consequence, the elongation at break of the thus partially oriented yarn (POY) and, thus, likewise its subsequent stretchability are reduced. For a polyester yarn (polyethylene terephthalate, and others), and for a polyamide yarn (nylon 6 and nylon 6.6), the physical dependence may be noted essentially from the diagram of German Patent 22 54 998 incorporated herein by reference. "Normal withdrawal speed" and/or "normal draw ratio", as used hereafter, are meant to be a draw ratio, which maintains the relationships in accordance with this diagram, i.e., the partially oriented yarn spun in conventional manner and not in accordance with the teaching of this invention.

Together with the total denier of the yarn that is to be produced, this physical dependence causes a limitation of productivity. The productivity again can be measured by the delivered quantity (quantity of the melt per unit time).

In a spin-draw and take-up process, the increase in the withdrawal speed does not result in a corresponding increase in productivity, since as the withdrawal speed increases, the stretchability decreases and, consequently, the take-up speed changes only little or not at all.

In such a continuous spin-draw and take-up process, the yarn advances immediately after spinning to a draw zone, and is wound after passing through the draw zone. draw ratio. Otherwise, the multifilament yarn will not withstand the stresses in the false twist texturing process. Individual filaments will break. An unsuitable draw ratio means not only an inferior quality of the produced yarn, but also involves the risk of interrupting the process by filament breakages.

In other production processes, critical conditions are to be expected within the spinning process. To this end, the withdrawal speed is predetermined within suitable limits. The withdrawal speed must be selected such that the partially oriented yarn can be produced safely and without filament breakages. This is especially necessary for high-tenacity yarns or yarns with a large number of filaments, which involve, due to a high air friction, the risk of filament breakages, and the thereby caused impairment of the yarn quality or interruption of the spinning process.

In both alternatives, an increase in productivity by increasing the melt delivery is possible, in the one alternative a yarn being wound in the spinning phase without raising take-up speed, but with an increased denier of the partially oriented yarn, and the yarn being drawn in the drawing phase at an increased draw ratio. Thus, in the drawing phase, the produced yarn length is likewise increased, while the total denier remains unchanged. In the other alternative, the increase in the melt delivery results in an increase of the take-up speed in the spinning phase.

The present invention permits the molten state of the melt strands emerging from the nozzle holes of the spinneret and becoming subsequently individual filaments is still maintained over a length, even though same is short.

The proposed solution has the advantage that a modification of the actual spinning device is In a discontinuous production process, a take-up occurs after spinning. The produced package is then supplied to a draw machine, and wound again after passing through the draw zone. In this process, the delivery, at which the melt is discharged, results from the total denier that must be reached at a given withdrawal speed and draw ratio. Due to the physical relationships, the conventional production process does not permit a significant increase in productivity to be realized for a yarn by melt spinning a partially oriented yarn and its subsequent drawing (see, treatise "Spinnstrecken-Schnellspinnen-Strecktexturieren" in International Textile Bulletin ITB, 1973, p. 374).

In a continuous production process, the desired total denier of the yarn to be produced and the desired melt delivery result in the take-up speed of the yarn, which corresponds substantially to the final speed of the draw system. By inputting a desired draw ratio, the withdrawal speed of the yarn from the spinneret is obtained, or vice versa, by inputting a desired withdrawal speed, the draw ratio is obtained in both cases in accordance with the predetermined physical relationship. An increase in the productivity results since it allows to break the described physical relationship between withdrawal speed and stretchability.

If one proceeds from a discontinuous production process, which includes the steps of spinning and winding the yarn in the spinning phase, and drawing and winding it again in the subsequent drawing phase, the following alternatives are possible:

There are processes, which require leaving the draw ratios within certain limits. This applies in particular to draw texturing. In the draw texturing process, not only the properties of the end product, but also the reliability of the texturing process are dependent on the selection of a suitable not needed, and that the heating length may be increased as desired or according to requirements.

Attempted is to heat the underside of the nozzle plate of the spinneret by more than 5° C., preferably 5° to 30° C. In the tests, the heating was about 10° C.

It should be remarked that several of the elements, which are subjacent the spinneret, may be heated. This allows to enlarge the length of the molten state of the filaments.

To achieve that heat, heat is supplied to the spinneret rather than to the filaments. Thus, it is desirable to design the heated elements in suitable manner. Since the melt is delivered already at a high temperature, the spinneret has already a temperature, which is in the range of the melt temperature. To heat the spinneret to a higher temperature, a corresponding temperature of the heated elements is necessary. This may require a direct heating of the elements. The tubular cooler of this design is especially suitable for the production of very fine fibers, i.e., microfibers.

The tubular coolers of the present invention, in one embodiment, have a length, preferably from 540 to 1650 mm, so as to spin individual filaments having a weight per unit length measure from about 0.5 to about 2 denier per filament (DPF). Preferably, filaments having a denier of about 0.5 DPF advance through a tubular cooler of a length from 540 to 700 mm, preferably from 600 to 700 mm.

Filaments having a denier of about 2 DPF advance through a tubular cooler that measures 1170 to 1650 mm long, preferably 1300 to 1500 mm.

BRIEF DESCRIPTION OF THE DRAWINGS

In the following the invention is described with reference to embodiments illustrated in the drawing, in which

FIG. 24 shows a Table.

DETAILED DESCRIPTION OF THE DRAWINGS

Figure 1:
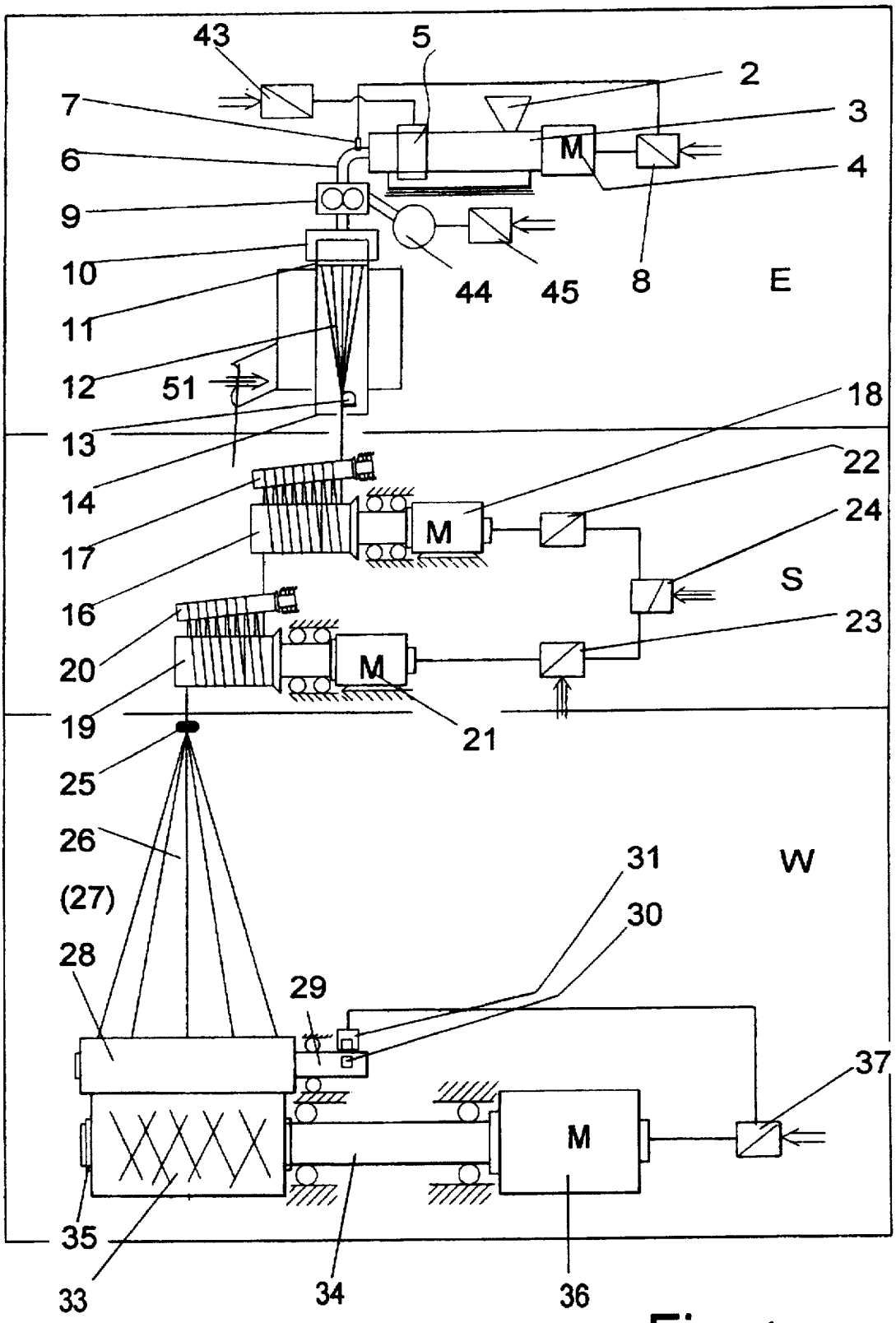
FIG. 1 is a schematic view of a continuous spin-draw process for producing a flat yarn.

The processes described below are equally suitable for spinning yarns of polyester, polyamide, or polypropylene. Considered for use as polyester is in particular polyethylene terephthalate. Used as polyamides are in particular nylon 6 (Perlon™) and nylon 6.6. It should be expressly remarked that the process data indicated below are for polyester. They apply accordingly to polyamide yarns with deviations that are to be established by tests.

Described below is the spinning process. This description applies to all embodiments (FIGS. 1–8), except deviations as will be expressly identified.

A yarn 1 is spun from a thermoplastic material. The thermoplastic material is supplied through a hopper 2 to an extruder 3. The extruder 3 is driven by a motor 4, which is controlled by a control unit 8. In the extruder, the thermoplastic material is melted. The work of deformation, which is applied by the extruder, assists in the melting process on the one hand. In addition, a heater 5 in the form of a resistance heater is provided, which is controlled by a heating control unit 43. Through a melt line, the melt reaches a gear pump 9, which is controlled by a pump motor 44. The melt pressure before the pump is detected by a pressure sensor 7, and maintained constant by feeding the pressure signal back to motor control unit 8.

The pump motor is controlled by a control unit 45 such as to permit a very fine adjustment of the pump speed. The pump 9 transports the melt flow to a heated spin box 10, the underside of which mounts a spinneret 11 accommodated in a spin pack 53 (note FIG. 4). From spinneret 11, the melt emerges in the form of fine filament fibers 12.

The spinneret as illustrated is a plate having a plurality of holes, from each of which a filament 12 emerges. The filament strands advance through a cooling shaft (tubular cooler) 14. In the cooling shaft 14, an air current 15 is directed radially to the web of filaments, thereby cooling the filaments. The cooling shaft is only schematically shown in FIGS. 1 and 2. It is constructed in accordance with the present invention, as shown in more detail in FIGS. 4–21.

At the outlet end of cooling shaft 14, the web of filaments is combined by an applicator roll 13 to a yarn 1, thereby receiving a liquid spin finish. The yarn is withdrawn from cooling shaft 14 and from spinneret 11 by a godet 16. The yarn loops several times about the godet. To this end, a guide roll 17 is used, which is axially inclined relative to godet 16. The guide roll 17 is freely rotatable. The godet 16 is driven at a preadjustable speed by a motor 18 and a frequency changer 22. This withdrawal speed is by a multiple higher than the natural exit speed of the filaments from spinneret 11. The adjustment of the input frequency of frequency changer 22 allows to adjust the rotational speed of godet 16, thereby determining the withdrawal speed of yarn 1 from spinneret 11.

Figure 2:
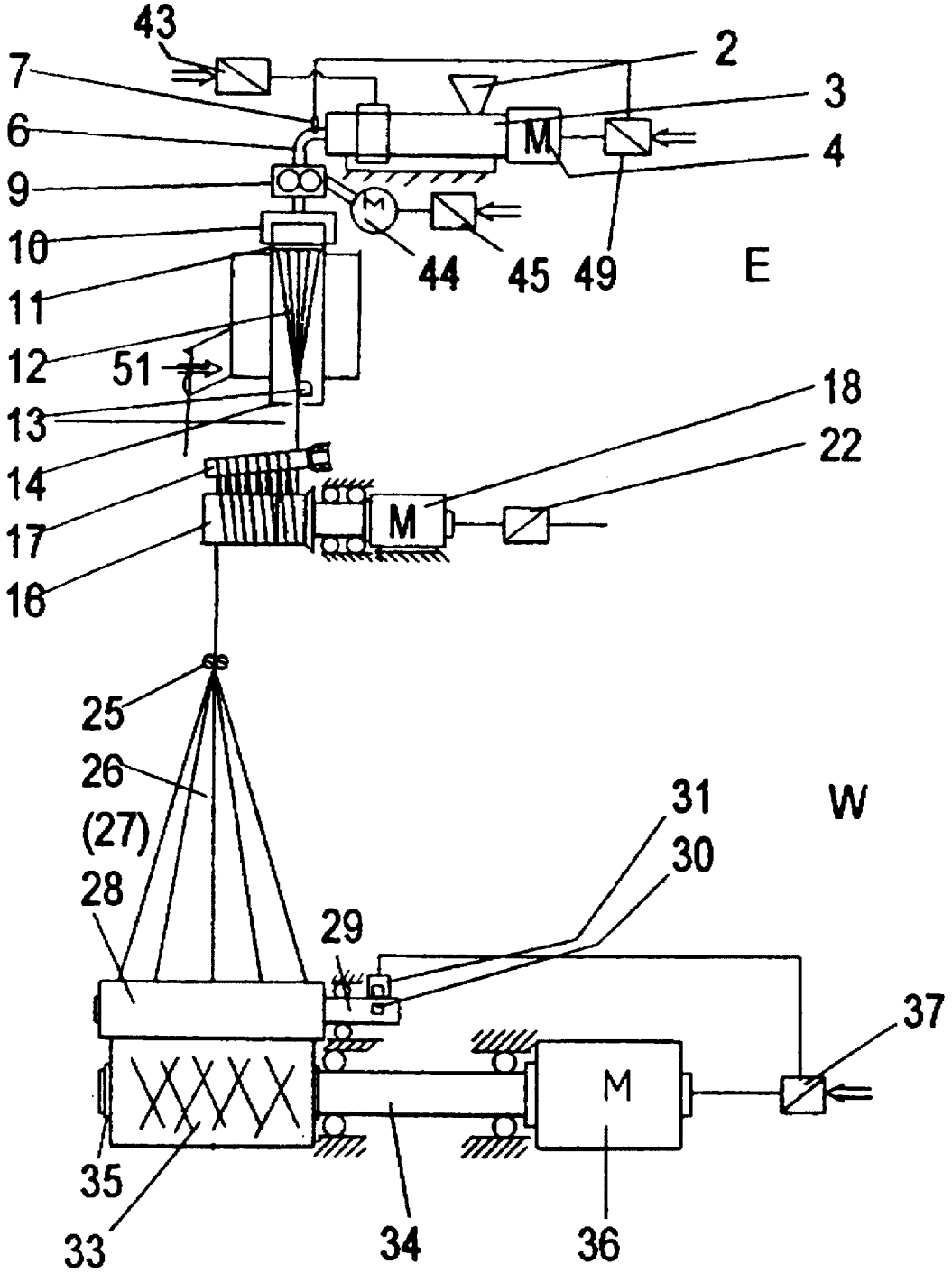
FIGS. 2 and 3 are a schematic view of a two-step process for spinning a partially oriented, flat yarn and for subsequently texturing the partially oriented yarn in a second process step.

Up to this point, the description applies in like manner to the spinning process shown in FIG. 2. For the drawing step in the schematic illustration of FIG. 1, the following description applies:

Downstream of godet 16 is a draw roll or godet 19 with a further guide roll 20. With respect to their arrangement, both correspond to that of godet 16 with guide roll 17. Draw roll 19 is driven by a motor 21 with a frequency changer 23. The input frequency of frequency changers 22 and 23 is evenly preset by a controllable frequency changer 24. In this manner, it is possible to individually adjust on frequency changers 22 and 23 the speed of godet 16 and draw roll 19 respectively, whereas the speed level of godet 16 and draw roll 19 is adjusted collectively on frequency changer 24.

From draw roll 19, the yarn 1 advances to a so-called "apex yarn guide" 25, and thence into a traversing triangle 26.

The following description will apply in like manner to the take-up step of the processes shown in FIGS. 1–8. In the Figures, the yarn traversing mechanism is not shown.

The traversing mechanism may be, for example, a cross-spiralled roll with a yarn guide traversing therein and reciprocating the yarn over the length of a package 33. In so doing, the yarn loops about a contact roll 28 downstream of yarn traversing mechanism 27. The contact roll 28 rests against the surface of package 33. It is used to measure the surface speed of package 33. The package 33 is wound on a tube 35, which is clamped on a winding spindle The spindle 34 is driven by a motor 36 and a spindle control unit 37 such that the surface speed of package 33 remains constant. To this end and for use as a control variable, the speed of freely rotatable contact roll 28 is sensed and corrected by means of a ferromagnetic insert 30 and a magnetic pulse transmitter 31.

In the process of FIG. 1, the adjustment of spindle control unit 37 allows to adapt the take-up speed to the circumferential speed of draw roll 19.

In the embodiment of FIG. 2, the yarn advancing from godet 16 moves on directly to apex yarn guide 25 and into the traversing triangle 26. In this embodiment, an adaptation occurs in corresponding manner between the circumferential speed of package 33 and the withdrawal speed, which is predetermined by godet 16.

In both cases, the circumferential speed of package 33, which is sensed and corrected by contact roll 28, is slightly lower than the circumferential speed of preceding godets 16 or 19, since the take-up speed of the yarn results as a geometric sum from the circumferential speed of package 33 and the traversing speed of a yarn traversing mechanism which is not shown.

Figure 3:
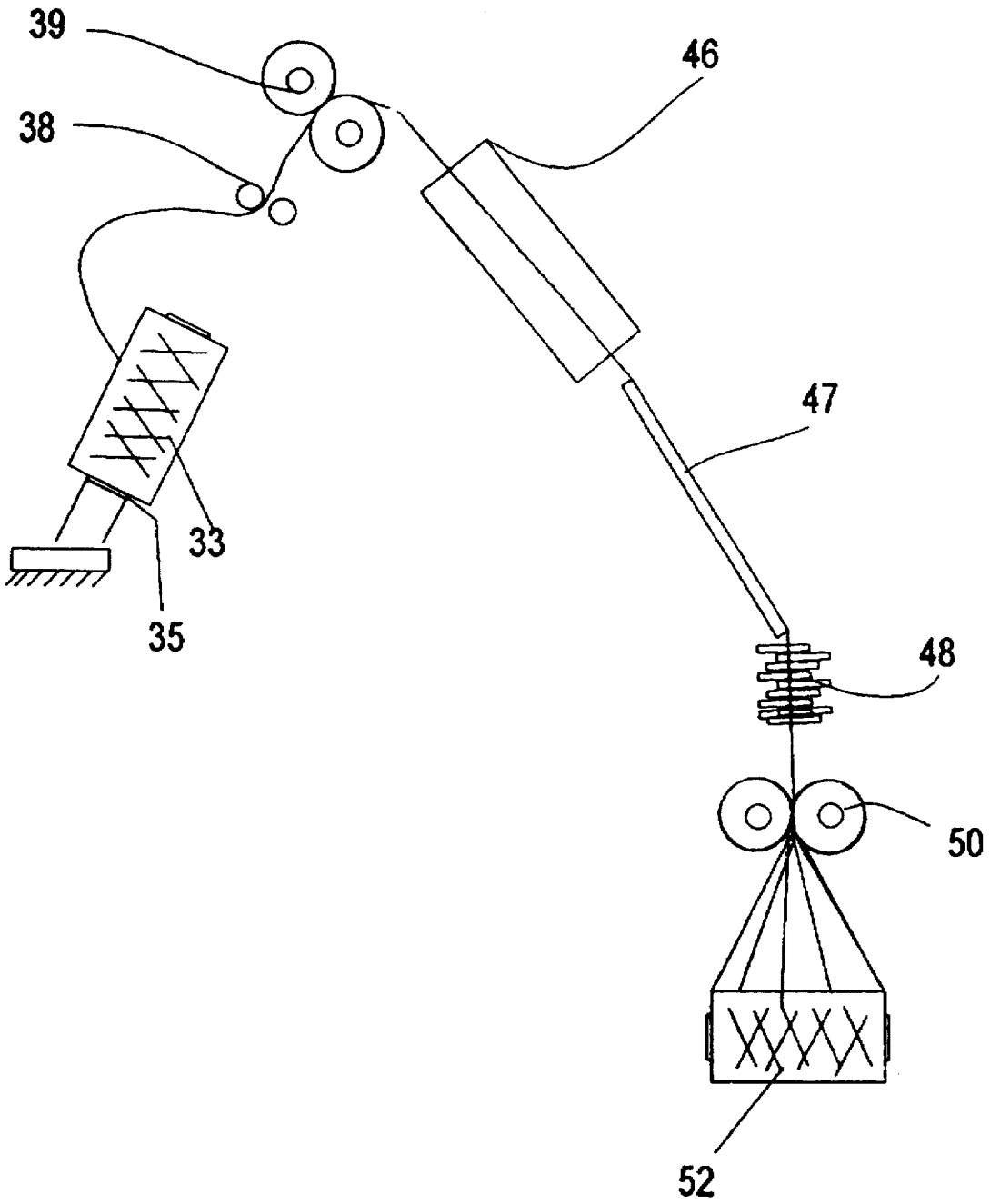

FIG. 3 is a schematic illustration of a draw-texturing process, which follows the process of FIG. 2. The package 33 with a partially oriented yarn, which was produced by the process of FIG. 2, is supplied to a draw-texturing machine. Yarn guides 38 advance the partially oriented yarn to a first feed system 39, from where the yarn passes through a heater 46, a cooling rail 47, a friction false twist unit 48, to a second feed system 50, so as to be subsequently wound to a package 52. The feed systems 39 and 50 are driven at different speeds. As a result, the necessary drawing occurs in the false twist zone between these feed systems along with a heating and a false twist texturing.

Referring now to FIGS. 4–8, the processes are described again together with the tubular cooler. As to more details, reference may be made to FIGS. 1–3. The process shown in FIG. 4 et seq. are characterized by the absence of the godets. The yarn is withdrawn from the spinneret by the take-up machine at a high speed, preferably 3,500 m/min. and higher, and thereby drawn at the same time.

From a spin head 10, spinneret 11 receives a metered quantity of a polymer melt. The spinneret 11 comprises a plate with a plurality of holes, from each of which one filament 12 emerges. Arranged below spinneret 11 is a tubular cooler 14. The filaments 12 advance through tubular cooler 14, and are combined by a yarn guide 60 downstream of tubular cooler 14 to a yarn 1. The yarn continues to advance through an entanglement nozzle 61 to a winding head 62.

The tubular cooler 14 includes a generally tubular wall which comprises several superposed annular elements 63. Arranged between two adjacent elements 63 is respectively one spacer 64, so as to form between two adjacent elements 63 an inlet opening (annular gas channel) 65. Through inlet opening 65, air flows to the filaments 12, thereby cooling same. The air escapes through an outlet opening 66.

The annular elements are, for example, steel rings. The rings have a constant cross section over their circumference.

The cross section is in this instance the section in an axial plane, namely, one of the planes, in which the tube axis or ring axis of the element extends.

The length of the cooling zone, which corresponds essentially to the height of tubular cooler 14, can be adapted accordingly to the cooling requirements by the number of the elements and the spacing between adjacent elements. Preferably the spacing is from 0.5 to 3 mm, in particular 1 mm. The velocity and the type of the cooling air flow can be influenced by the cross sectional flow area of the openings 65 as well as the width of the rings.

In the embodiment of the tubular cooler, as shown in FIGS. 4–8, 14, and 18, the annular elements have a rectangular cross section, when sectioned lengthwise with respect to the vertical central axis of the tubular wall. Therefore, the cross sectional flow area of each opening 65 is constant. Furthermore, it results from this configuration that each annular gas channel 65 defined by the opening 65, which is formed between elements 63, has horizontal boundary walls. Each gas channel extends thus exactly in a radial direction, when related to the vertical axis of the elements and the tubular cooler.

Figure 9:
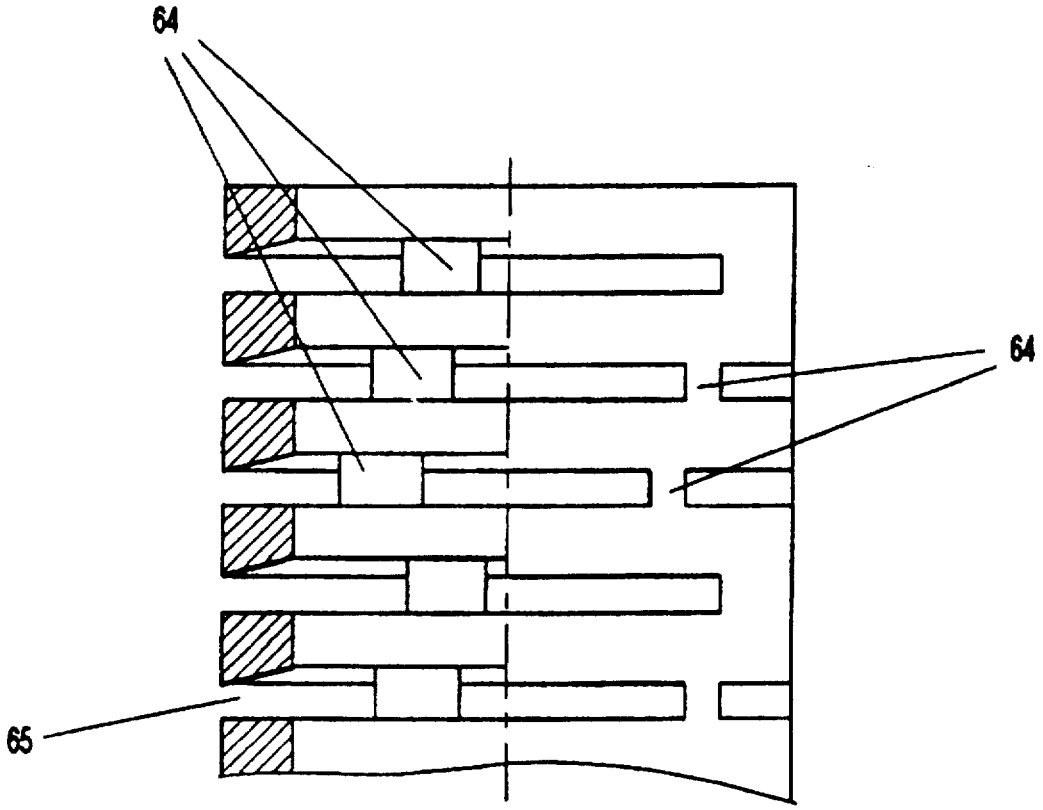
FIG. 9–9*a* are a partial sectional view of a third embodiment of a tubular cooler.
Figure 9A:
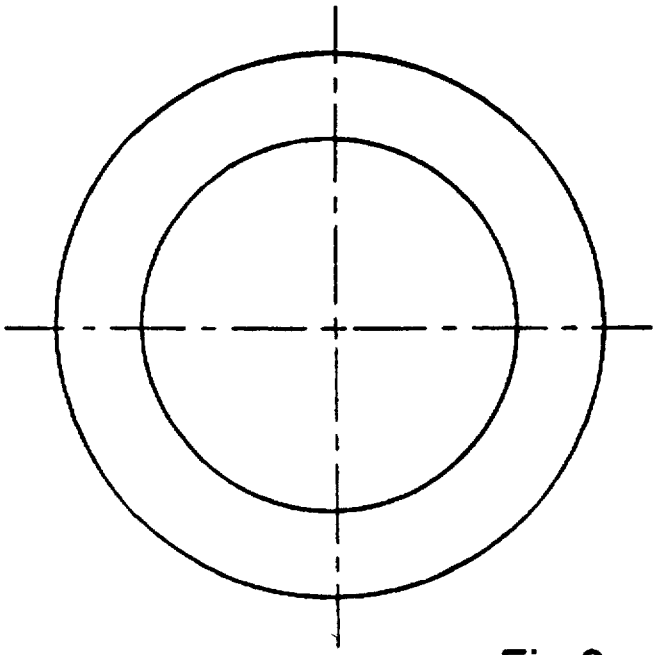
Figure 10:
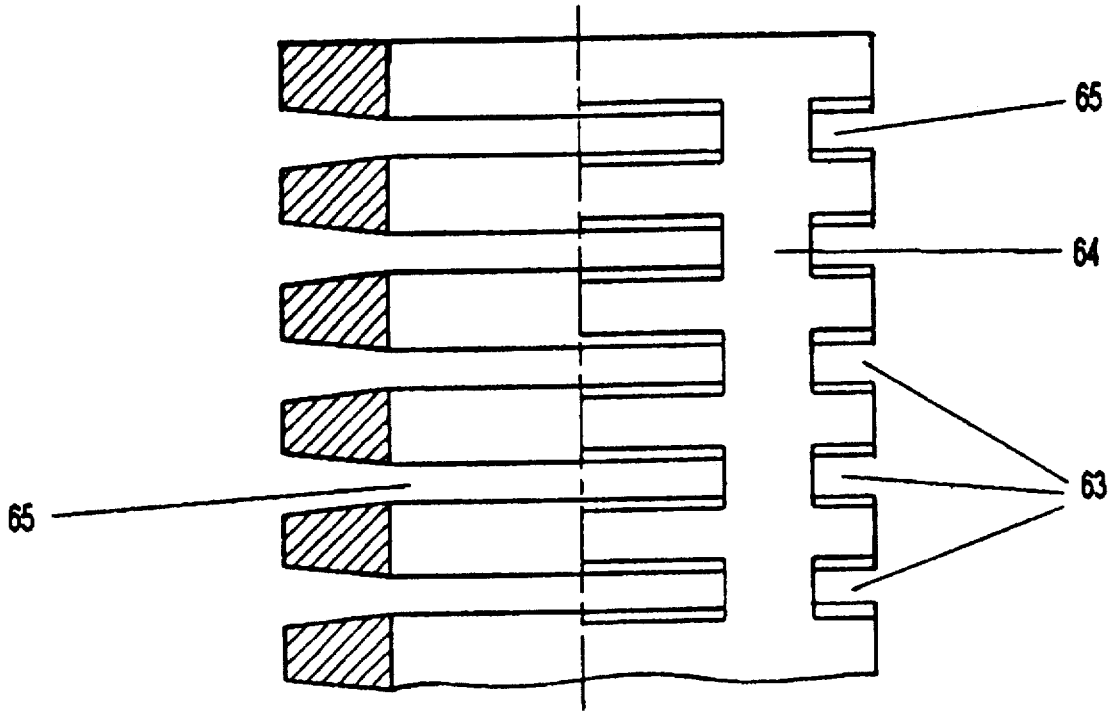
FIGS. 10–10*a* are a partial sectional view of a second embodiment of a tubular cooler.
Figure 10A:
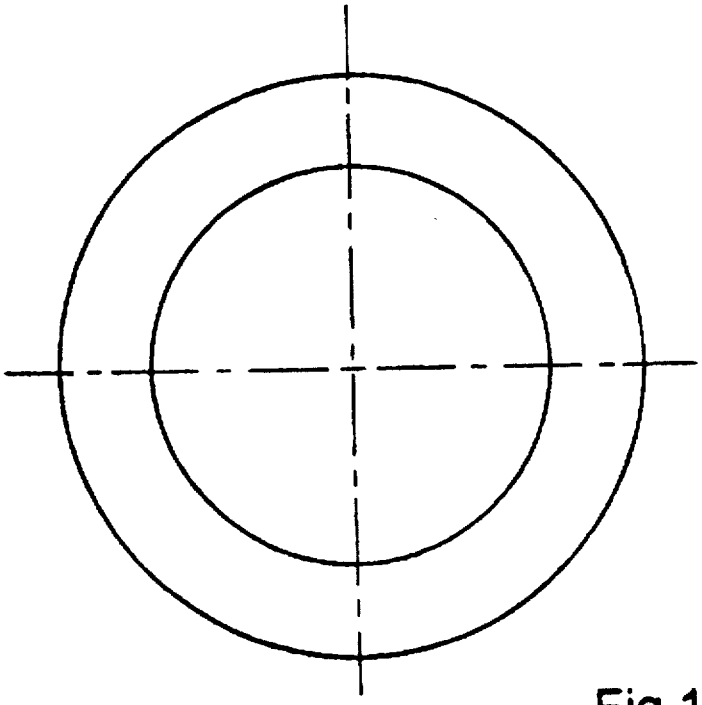

In the embodiment of FIGS. 9–10, the elements have a trapezoidal cross section, when cut lengthwise with respect to the central axis 78. In the embodiment of FIG. 10, they become thicker from the outside to the inside. Therefore the cross sectional flow area of gas channel 65 varies in direction of the flow, i.e. from the outside to the inside, in the meaning of a narrowing with the consequence of increasing the velocity of the flow.

The cross section of the elements, when cut lengthwise, can also decrease conically from the outside to the inside, as shown in FIG. 9, thus reducing the velocity, at which the air flows into the tubular cooler.

Shown in FIG. 9 is such an embodiment, in which the cross sectional flow area increases from the outside to the inside. Each element 63 has a trapezoidal cross section perpendicularly to the ring plane. The spacers 64 are circumferentially offset in the embodiment of FIG. 9. This arrangement can lead to a more uniform cooling of the filaments.

Figure 12:
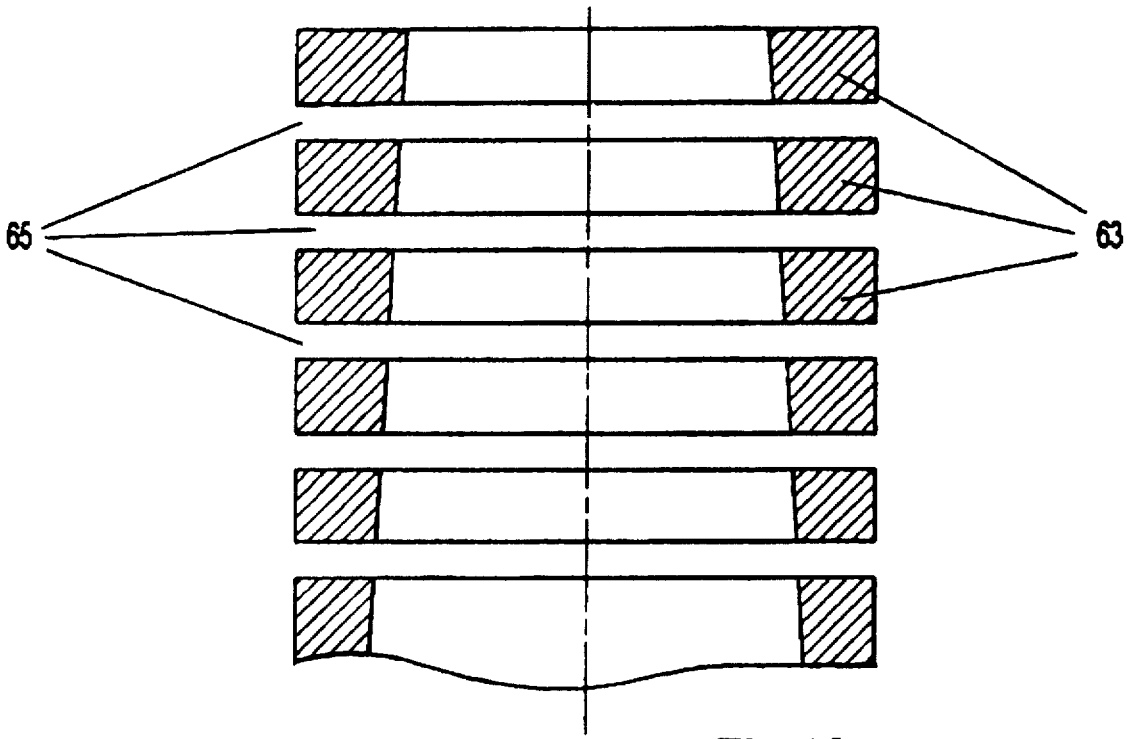
FIGS. 12–12*a* are a full sectional view of a fourth embodiment of a tubular cooler.
Figure 12A:
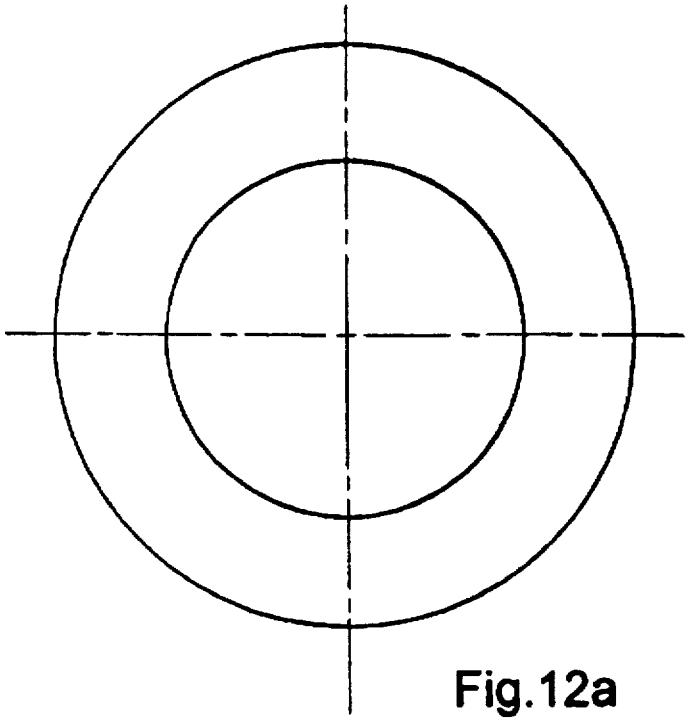

The speed of the advancing filaments is very characteristic and distinguishes itself in that, initially, it is relatively low and, thereafter, increases very considerably. To compensate for this effect during the cooling, the flow rate of the cooling gas may be variable in direction of the advancing filaments. Likewise, it may be necessary to adapt the cooling air flow to the temperature characteristic of the filament bundle. To control the cooling air flow as a function of the filament speed or temperature characteristic of a filament bundle, it is proposed to configure the elements such that the inside cross section of the tubular cooler increases in direction of the advancing filaments, as is shown in FIG. 12. To this end, the inside cross section of the passage formed by the elements widens.

Figure 11:
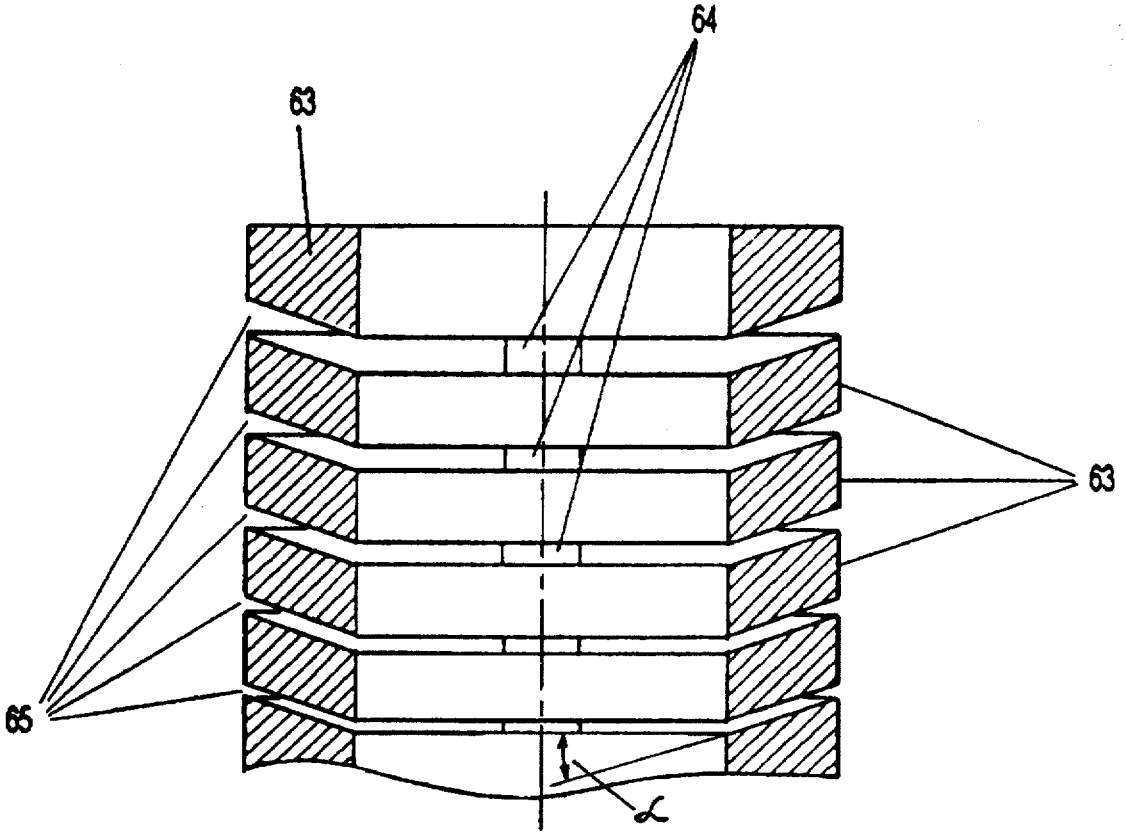
FIGS. 11–11*a* are a full sectional view of a fifth embodiment of a tubular cooler.
Figure 11A:
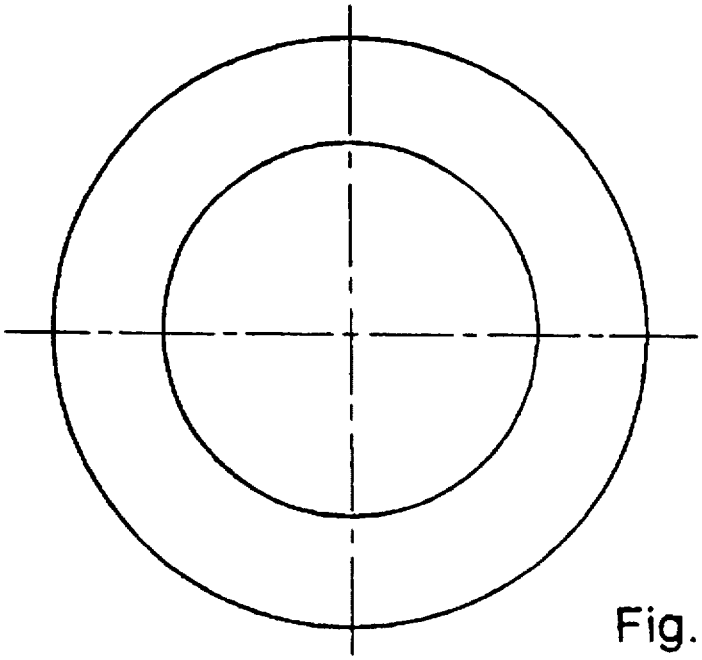

Instead of varying the inside cross section of the passageway in the tubular cooler, it is proposed in FIG. 11 to vary the spacing between elements 63 relative to each other. The spacing between respective adjacent elements 63 decreases in direction 74 of the advancing filaments.

It may be required that the cooling air flow into the tubular cooler not perpendicularly, but at a certain angle $\alpha$ relative to the direction 74 of the advancing filaments, such as is shown in FIGS. 9, 11, 15, 19, and 20. When the air flows oppositely to the direction of the advancing filaments, as in FIG. 10, this flow will cause the air friction of the filaments to increase and, thus, the tension for winding the yarn rises. A flow that reaches the interior of the tubular cooler at an angle in direction of the advancing filaments, such as in FIGS. 11, 15, and 19, decreases the tension, under which the filaments combined to a yarn must be withdrawn from the spinneret.

In summary, the cross sectional configuration of the elements, when related to the axial plane with respect to the axis of the tubular cooler, allows to define the shape and/or the direction of the gas channel. To the extent that the axial width of the gas channel changes in radial direction, the direction is predetermined by a central plane 73, as shown in particular in FIGS. 19–21. Described as central plane is the disk-shaped or conical plane, which has in all points the same distance from the boundary surfaces of the elements forming the gas channel, the distance being measured axis parallel to the tube axis. In all cases, the gas channels have a radial flow component to the tube axis and, in special cases, even a flow component parallel to the tube axis against or in the direction of spinning.

Figure 14:
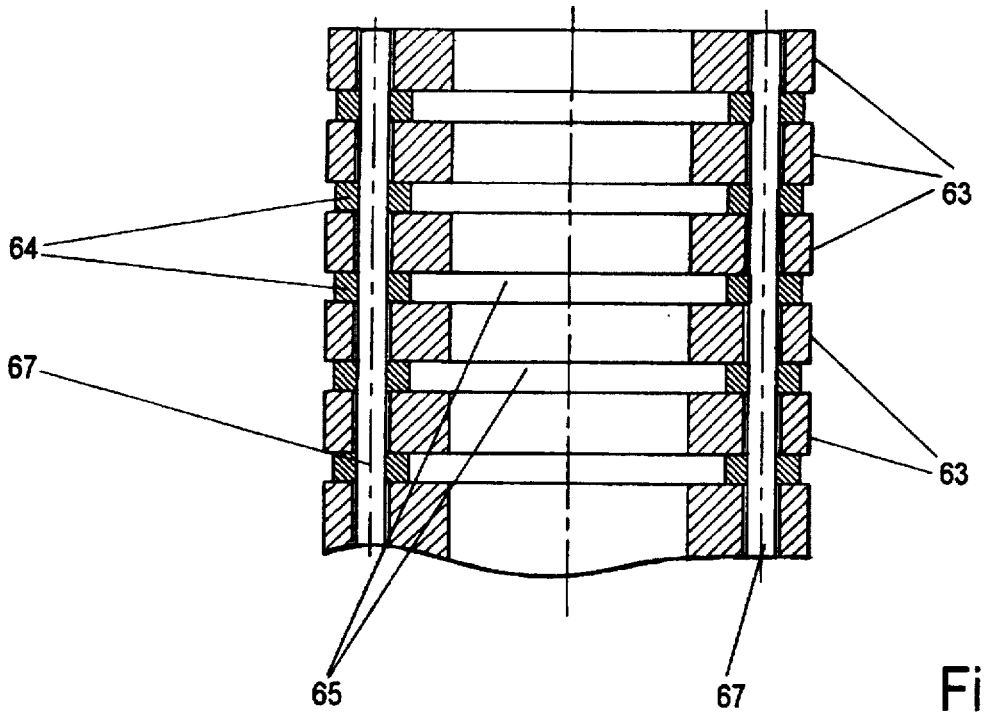
FIG. 14 is a full sectional view of a sixth embodiment of a tubular cooler.

The individual elements may lie on the spacers. To support the elements, same may however be mounted likewise on a holder, so that adjacent elements are spaced apart. Primarily, the holder may be an axial guideway, which extends parallel to the tube axis. To this end, each element 63 is provided on the side of its edge with at least one through bore, through each of which a bar 67 extends as an axial guideway. In the illustration of FIG. 14, two bars 67 are provided. The bars 67 may be provided at their end with a screw thread, it being then possible to secure elements 63 between two nuts, which are screwed on the respective end of bar 67.

In the place of bars, the spacers 64 may have a cross section in the axial plane relative to the tube axis, which is adapted to the cross section of the elements, or which is adapted to the cross section of the gas channel that is formed between adjacent elements. These spacers having a small extension in the circumferential direction of the tubular cooler form each with elements 63 a formlocking engagement (FIG. 13).

Figure 15:
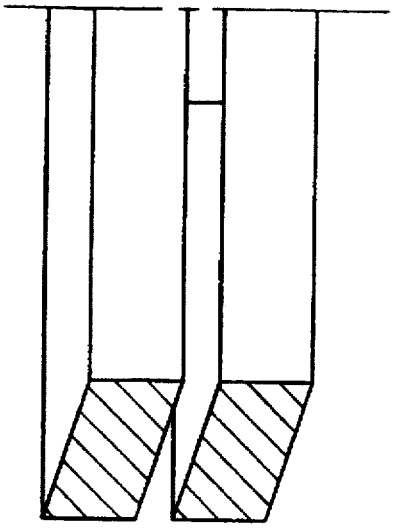

The flow area or cross section of openings 65 may be realized by the different geometries of elements 63. As shown in FIGS. 14 and 15, the cross section of openings 65 is constant. However, the flow direction into the tubular cooler is different.

Figure 13:
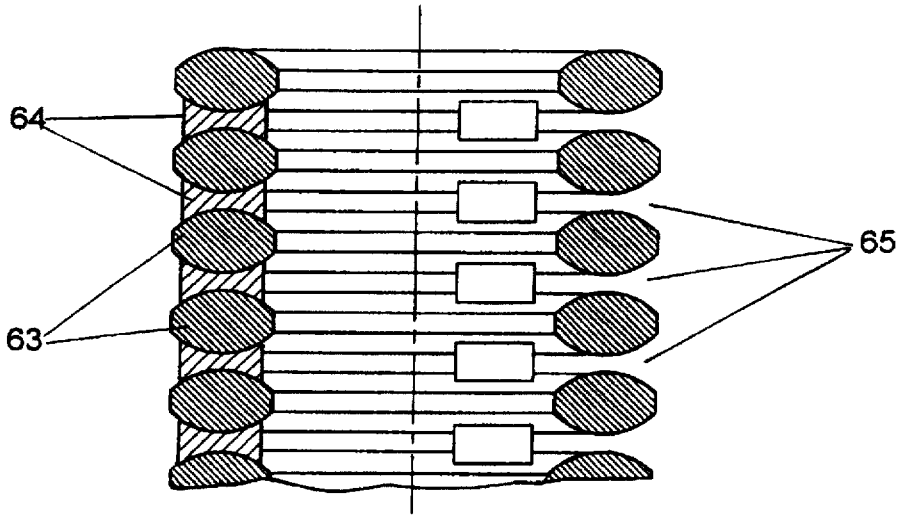
FIG. 13 is a full sectional view of a seventh embodiment of a tubular cooler.
Figure 16:
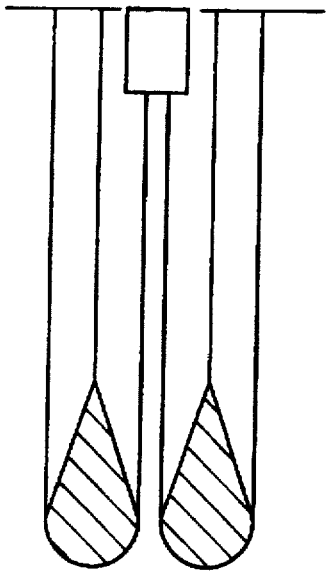
FIGS. 15–18 illustrate embodiments of the elements of a tubular cooler.
Figure 18:
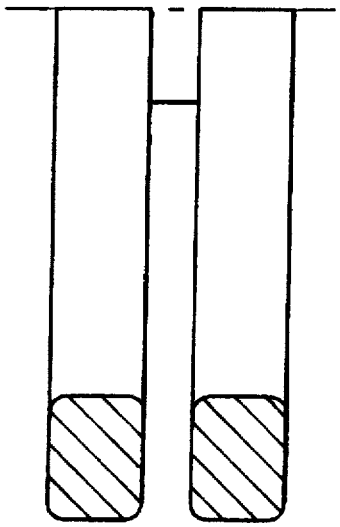

In FIGS. 10, 13, and 16, the cross sections of elements 63 create an annular flow channel with a nozzle-type configuration, which accelerates the inflowing air.

Figure 17:
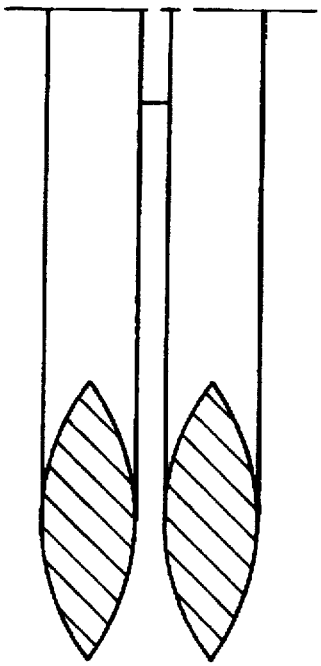
Figure 19:
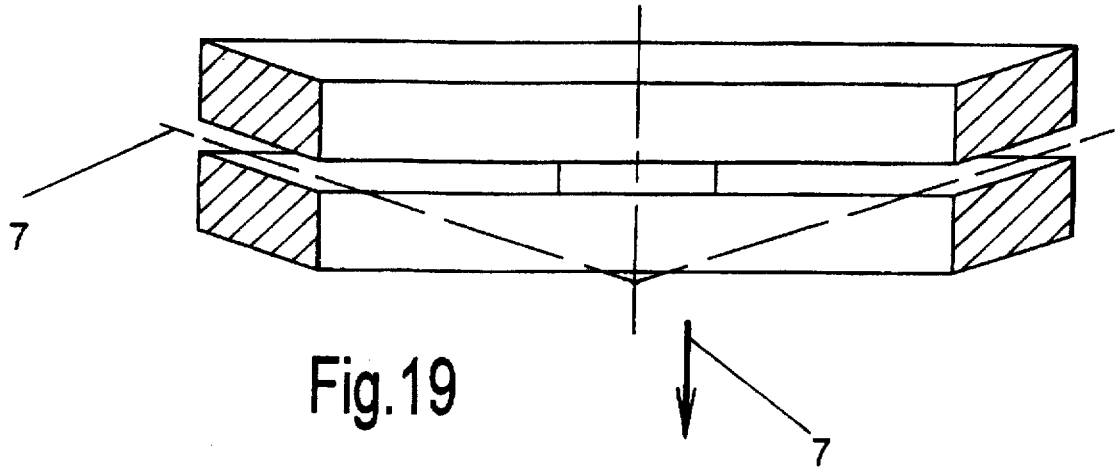
FIGS. 19–21 are detail views showing configurations of the flow channel and elements.
Figure 20:
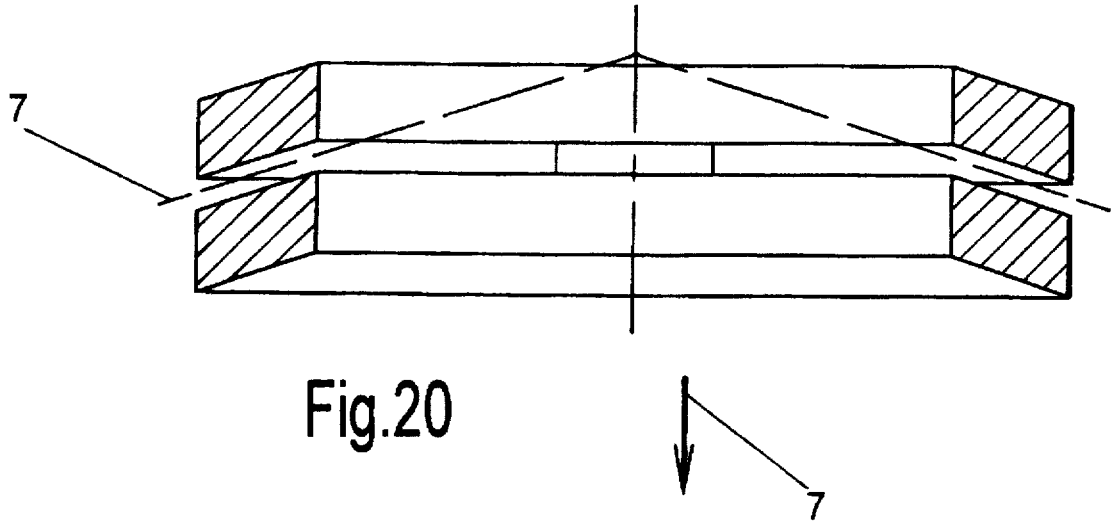
Figure 21:
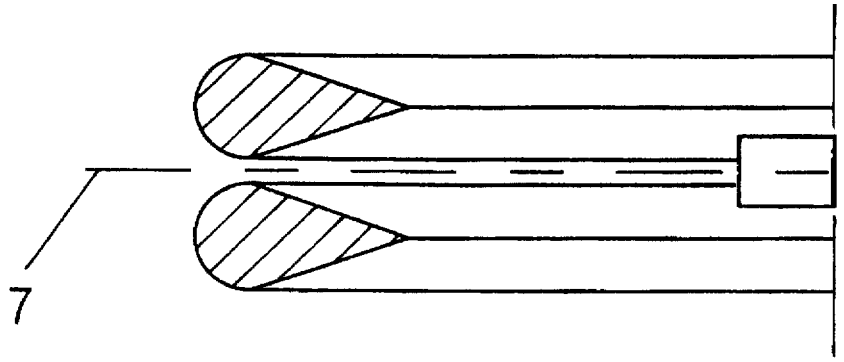

To this end, the boundary surfaces of adjacent elements 63, which face each other and form the gas channel, are directed toward each other with a convex curvature. Corresponding cross sectional shapes of the elements are shown in FIGS. 13, 16, and 17. These shapes make not only the gas channel itself favorable to the flow. As a result of the drop-shaped cross section of the elements in FIG. 16, which narrows in direction of the flow, or the lens-shaped cross section of FIG. 17, it can also be accomplished that the air streaming around the elements meets with only little resistance to its flow, so as to result in an adequate quantity of flow, even when the difference between the pressure outside and the pressure inside the tubular cooler is small.

Figure 4:
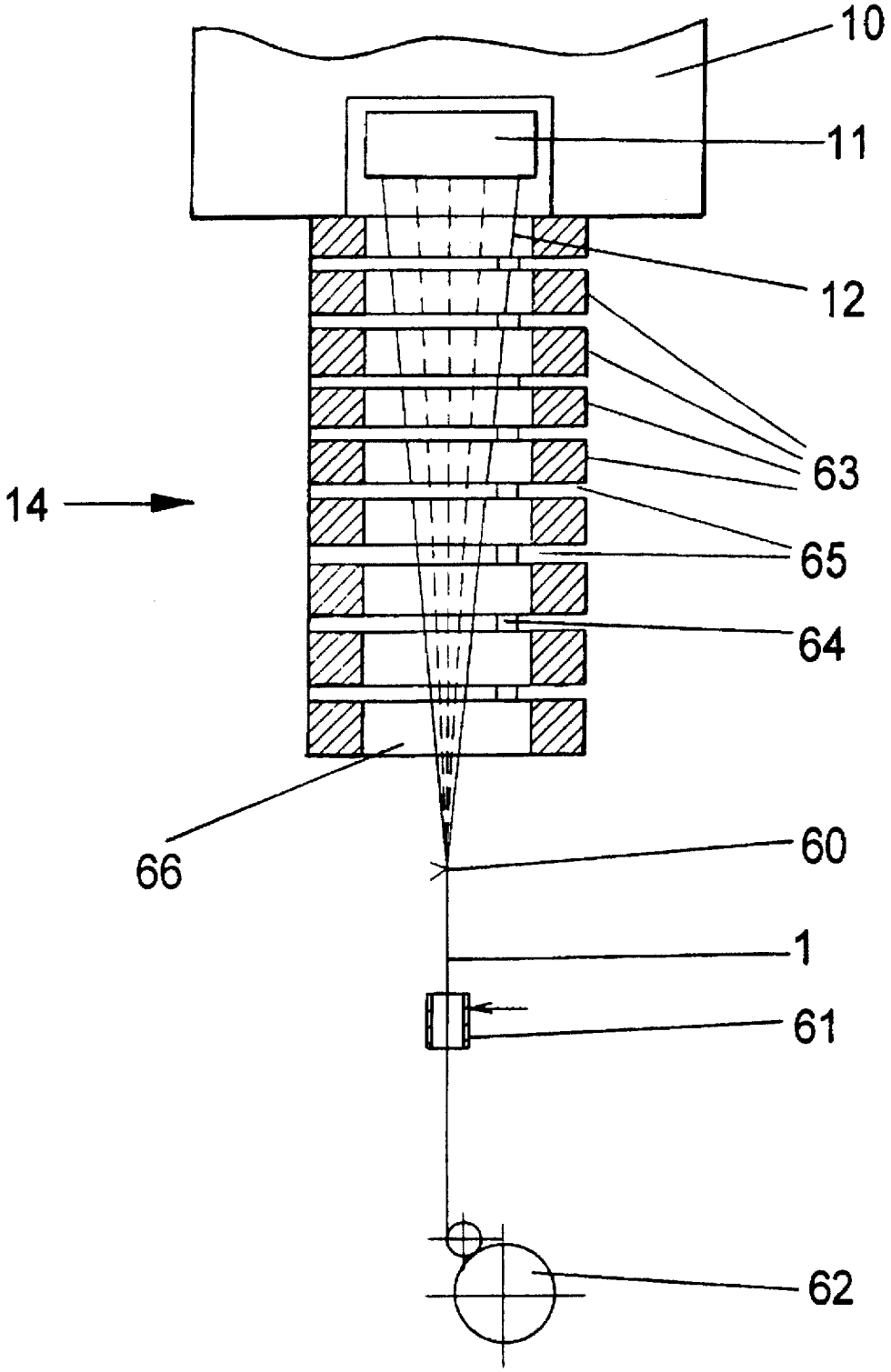
FIG. 4 is a schematic view of a spinning apparatus with a full sectional view of a first embodiment of a tubular cooler.
Figure 6:
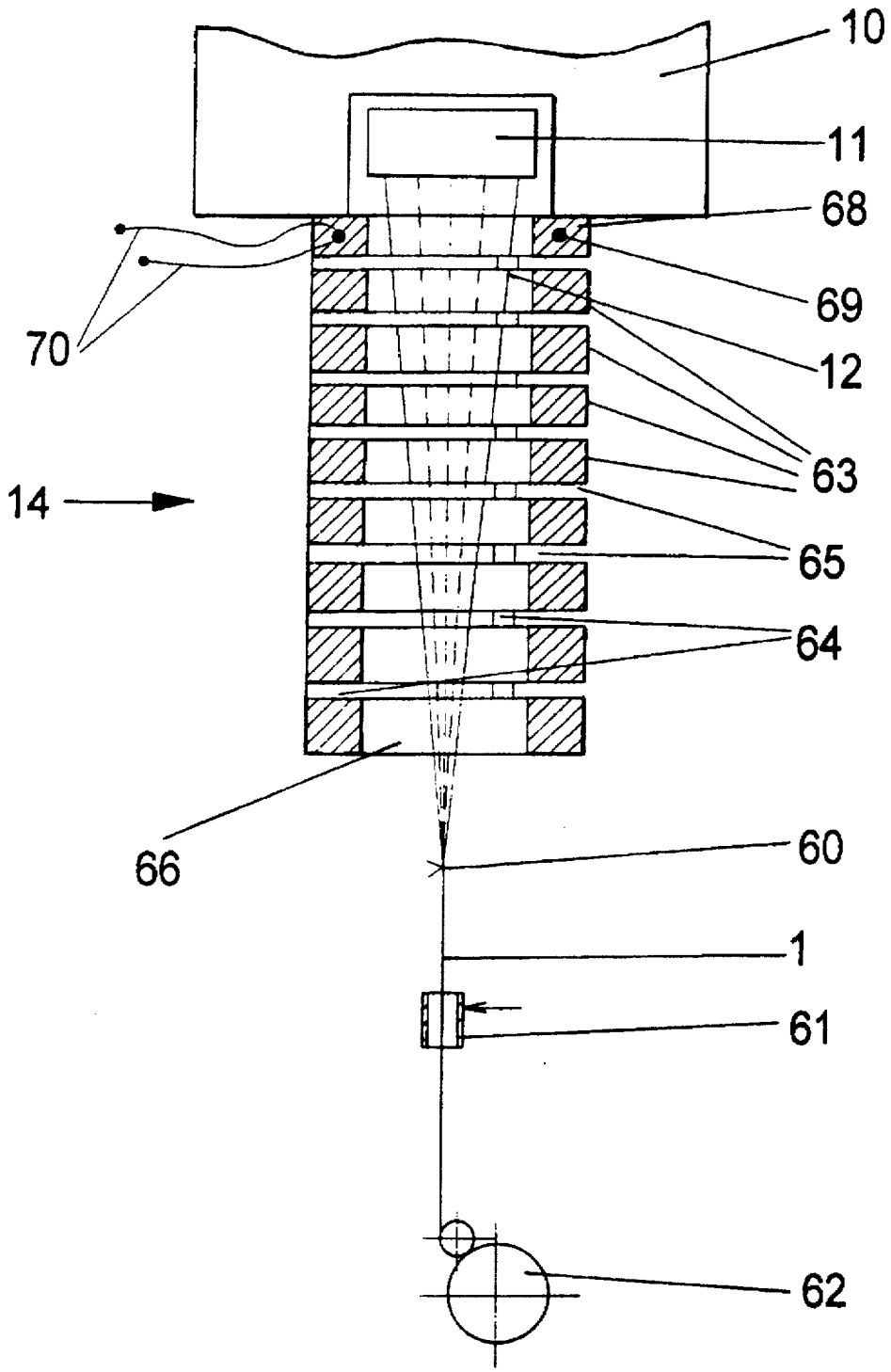
FIG. 6 is a schematic view of a spinning apparatus with a full sectional view of a further embodiment of a tubular cooler.

With reference to FIGS. 4 and 6, spinning systems with tubular coolers have been described, in which a difference between external pressure and internal pressure develops, in that, due to their high speed of withdrawal from the spinneret, the spun filaments entrain a large amount of cooling air, thereby generating a vacuum in the interior of the tubular cooler. Such embodiments require a certain withdrawal speed. This withdrawal speed is at least 3500 m/min. Preferably, the withdrawal speed is higher than 5000 m/min. This instance results in the further advantage that the spun filaments exhibit an adequate orientation and need not be subjected to a further, subsequent drawing, thus permitting the produced packages to be supplied immediately to further processing. In this manner, it is in particular possible to also spin microfilaments. It has been shown that in their instance it is necessary to adapt the length of the tubular cooler very sensitively to the denier of the spun filaments. Particularly suitable therefor is the tubular cooler of the present invention, since it is very flexible with respect to its length by removing or adding further annular elements. Likewise, it allows to control the amount of cooling air by adjusting the gap width, even when, as in this instance, the pressure difference which is responsible for the quantity of flow, is not controllable. Filaments with an individual denier (dtex per filament=DPF) of 0.5 DPF require a length of the tubular cooler from 540 to 770 mm, preferably from 600 to 700 mm. Filaments with an individual denier of 2 DPF require length of the tubular cooler from 1170 to 1650 mm, preferably from 1300 to 1500 mm.

Figure 5:
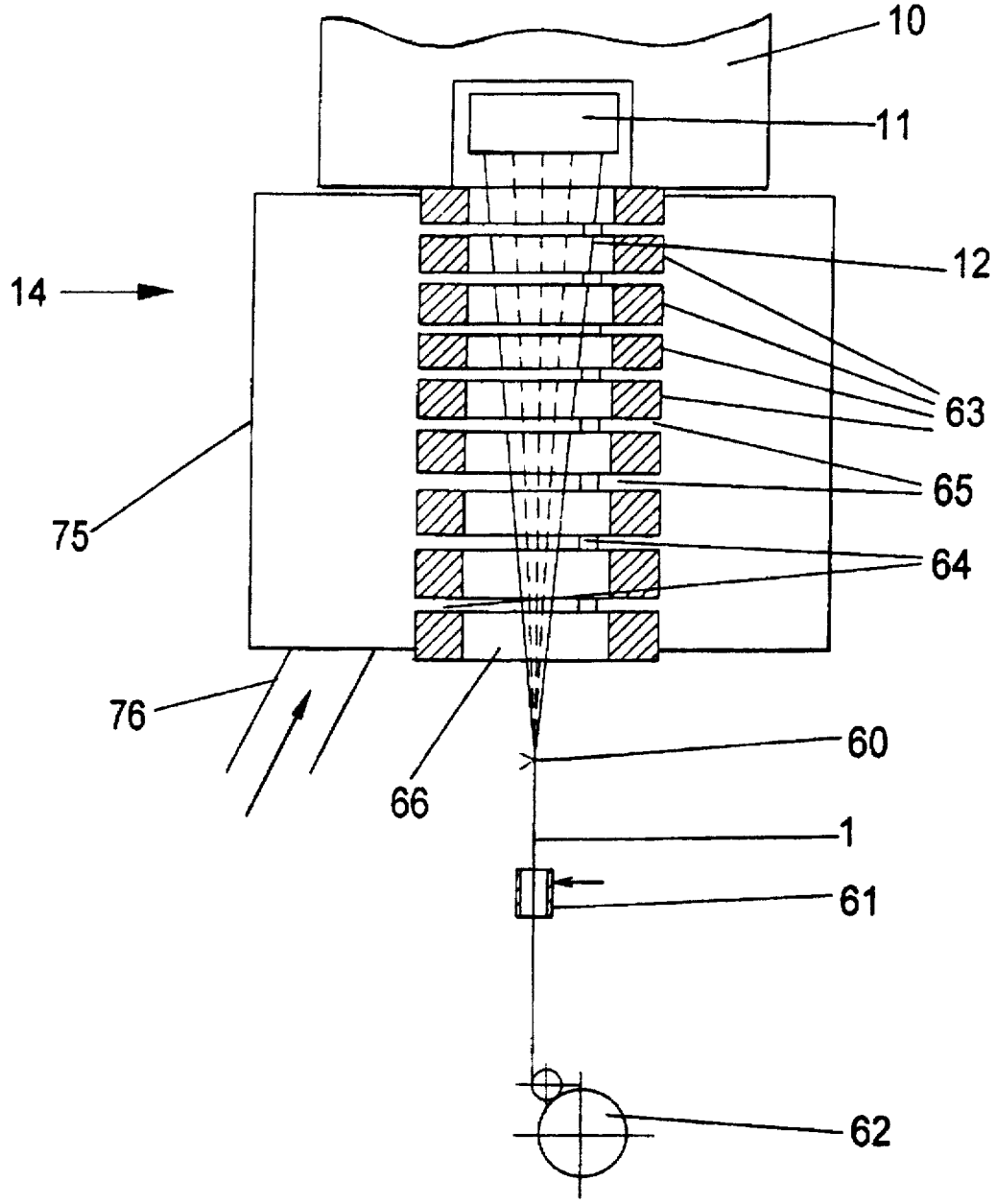
FIG. 5 illustrates an embodiment with a pressure-controlled supply of cooling air.
Figure 7:
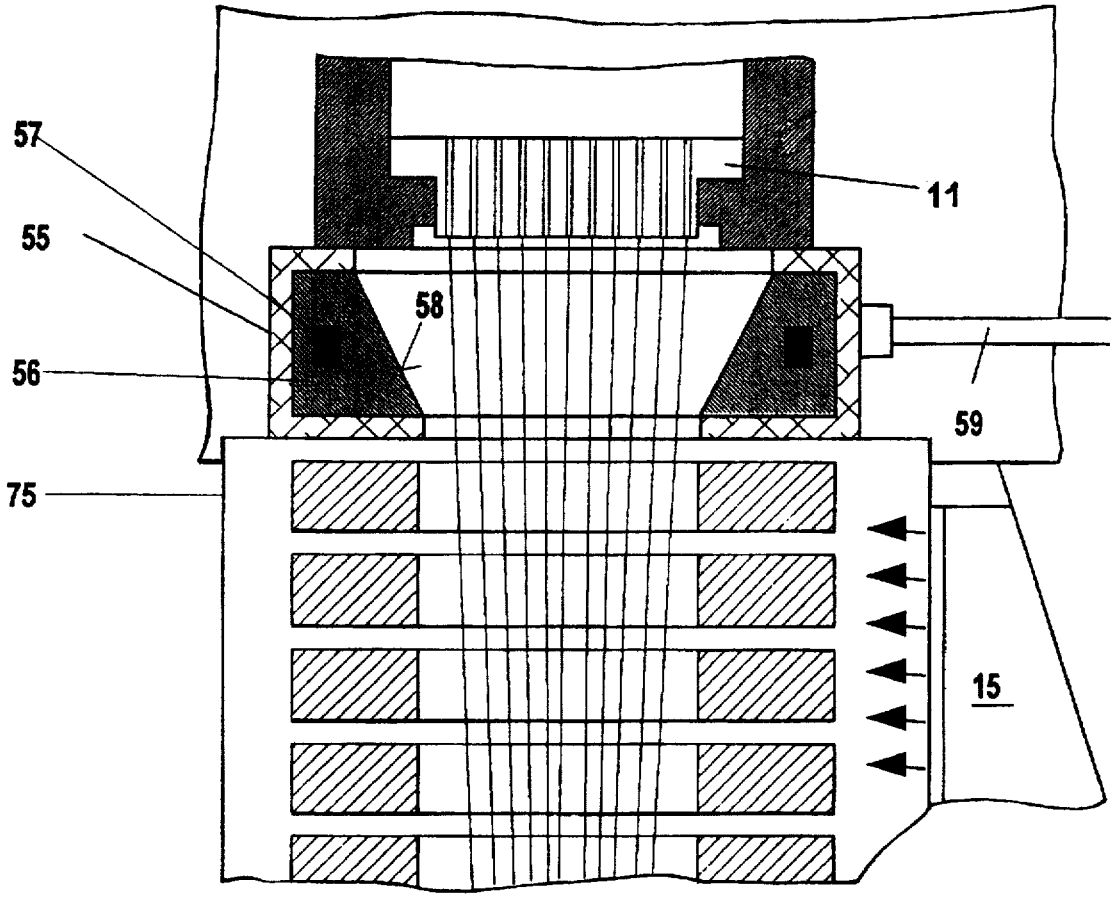
FIG. 7 is a sectional view of the region of the spinneret with a heated element of the tubular cooler.

Shown in FIGS. 5 and 7 are cylindrical tubular coolers, which are enclosed in a pressure box 75. Likewise, these tubular coolers may be constructed as has been described above with reference to FIGS. 9–21. The upper and the lower element are sealably inserted into pressure box 75. Arranged therebetween are further elements 63 with corresponding spacers and, possibly, an axial guideway, which form as a whole the cylindrical tubular cooler. The pressure box 75 receives compressed air via a supply line 76, for example, by means of a blower. As a result, cooling air flows through the tubular cooler from the outside to the inside. As regards the cross sectional configurations of the gas channels and elements, as well as the arrangement of spacers and axial guideways, the foregoing description is herewith incorporated by reference.

Up to this point, embodiments have been described, in which filaments 12 advance inside tubular cooler 14. However, the tubular cooler 14 may also be used to cool filaments 12, which advance along the outer jacket of the tubular cooler.

Figures 8A, 8B:
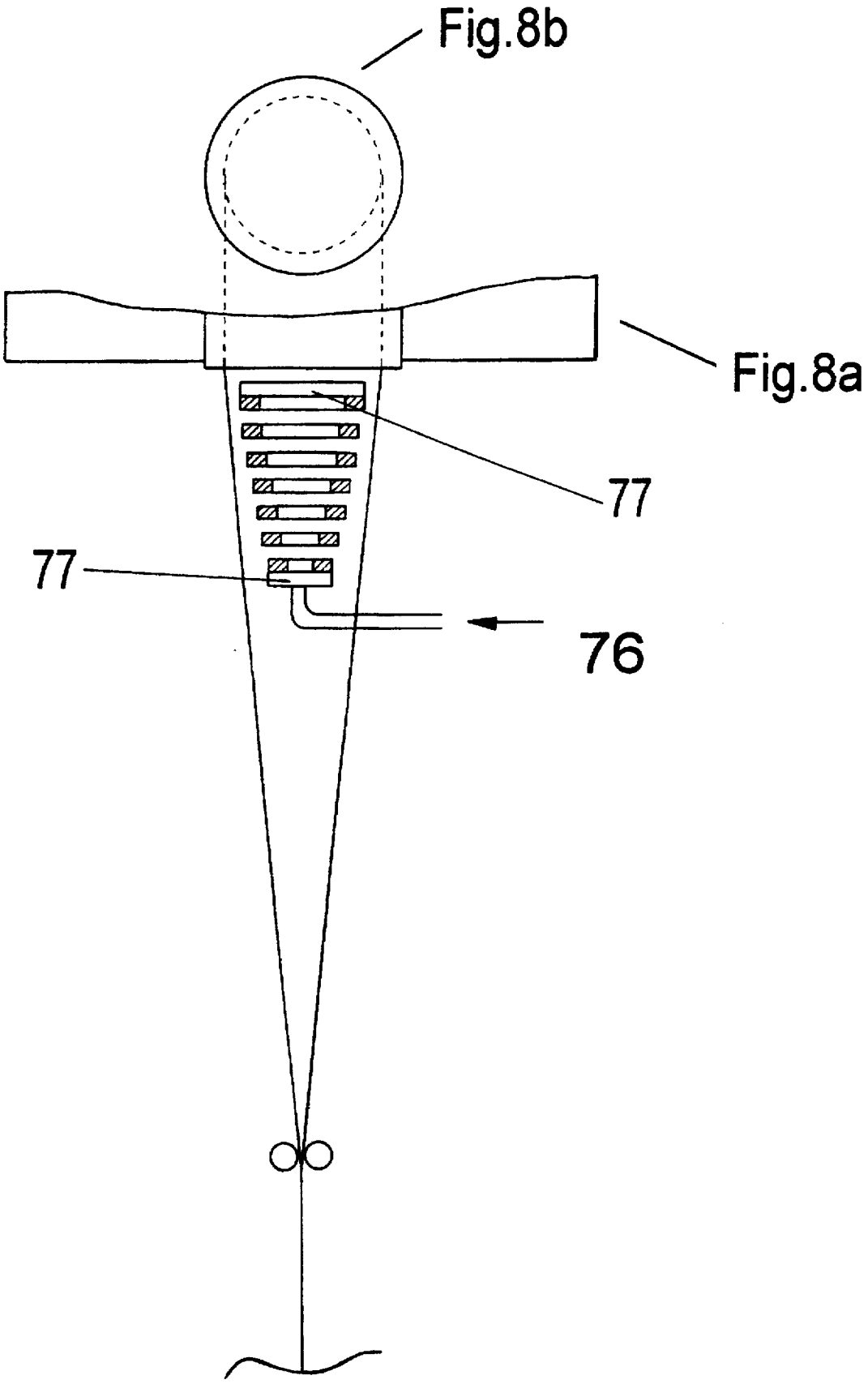
FIGS. 8*a*–8*b* illustrate an embodiment for a radial supply of cooling air in the center of the filament bundle.

This is shown in FIGS. 8*a*–8*b*. Shown in FIG. 8*b* is a bottom view of the spinneret, in which the individual nozzle holes are arranged in one, or more, concentric circles. Located below and concentric with the circles is the tubular cooler. The latter is again composed of individual, annular elements, as previously described with respect to shape, cross section, and configuration of the gas channel.

Arranged respectively between two adjacent elements are spacers, so that one opening 65 is formed respectively between two adjacent spacers. Air flows through opening 65 to the filaments 12.

The largest outside diameter of the element is smaller than the smallest circle, along which the nozzle holes are located. The outside diameter of the elements becomes smaller in the direction 74 of spinning, so that the tubular cooler or its surrounding surface forms a conical surface tapering in the direction of spinning.

The upper side of the tubular cooler, i.e. its end subjacent the spinneret is closed by a plate 77. The opposite end is likewise closed by a plate 77. However, in this latter plate, a supply line 76 terminates, through which compressed air is supplied by means of a blower. The filaments advancing in concentric relationship with the tubular cooler and in the pattern of a conical surface, are combined downstream of the cooler to a yarn by means of a yarn guide. This conical surface that is formed by the filaments is interrupted only at one point of its circumference by air supply line 76. The filaments must be deflected accordingly. The cooling of the filaments occurs by air flows, which are directed against the filaments substantially radially from the inside to the outside.

Shown in FIG. 6 is a schematic view of an embodiment of a tubular cooler, which corresponds to that of FIG. 5 and, accordingly also the description thereof. In addition, an element 68 close to spin head 10 is heatable, for example, by means of an electric resistance heater 69. The resistance heater is a resistance wire or rod that is embedded in the element. The resistance heater 69 is connected, via lines 70 to a source of voltage not shown. It is also possible to provide several heatable elements. Whether or not such elements are provided is a question of the requirements that are to be met by the apparatus, so as to adjust the desired temperature profile within the treatment zone of filaments 12. Primarily however, this arrangement allows to heat spinneret 11.

A similar embodiment is illustrated in FIG. 7, except the tubular cooler that is again, as an example, accommodated in a pressure box, as described above with reference to FIG. 5, the description of which, and likewise that of FIG. 6 are herewith incorporated by reference. In the embodiment of FIG. 7, a heated annular element 56 is positioned immediately below the spinneret 11, and the element 56 is heated by means of an electric resistance heater 57 that is embedded in the element 56 and which is connected to a power source via lines 59. The heated annular element 56 has a radiation surface 58, which is directed toward spinneret 11. The same applies to FIG. 6, where the radiation surface is formed by the upper side of the element that is in part directed toward the spinneret. In the embodiment of FIG. 7, however, the radiation surface is formed by the inner boundary wall which is made conical with a downward directed apex of the cone. As a result of heated element 56 and its radiation in direction toward the spinneret, the latter is heated. This means on the one hand, that the spinneret is prevented from cooling below the melt point of the polymer, whereas on the other hand a temperature increase is attempted by this heating. Otherwise, the tubular cooler is constructed in the same manner as previously described. Except for its radiation surface 58, the heated element is embedded in an insulating jacket 55.

The importance of this heating becomes apparent from the following description of examples:

Shown in FIG. 1 is a continuous spin-draw process. In this process, the total denier results from the take-up speed and the delivery of the melt.

For example, a yarn having a total denier of 2 denier per filament is to be produced. The withdrawal speed is to be 3000 m/min. Under normal circumstances, i.e. without heating the spinneret, this results in an elongation at break of the produced yarn of 120%. In other words, this means that the partially oriented yarn can be drawn to 220% of its length before breaking. As a consequence thereof, the draw ratio is about two thirds of this value, namely, for example 1:1.6.

This results in a withdrawal speed of 4800 m/min. (3000 m/min×1.6=4800 m/min). With a filament having, as aforesaid, a weight per unit length measure of 2 denier per filament and a number of 72 filaments, the result is a total denier of 150. From this, the melt delivery for each spinning position is 150 g: 9000 m×4800 m/min=80 g/min. Assuming now that the withdrawal speed for the production of the same yarn is increased to 4000 m/min, the elongation at break will be 80%, i.e., the yarn can be drawn to 180% of its length before breaking. When a draw ratio having again an approximate range of two thirds is selected, the draw ratio will be 1:1.2. This means that the withdrawal speed is not increased.

It is obvious that the melt delivery of the discharge pump cannot be increased in the production of the same total denier. Therefore, the increase in production or productivity is irrelevant.

For this reason, the tubular cooler is provided with one or several heated elements as shown in FIG. 6 or FIG. 7. A suitable angle of cone (total angle) for the radiation surface is, for example 30° to 40°. The element (steel) is to be heated to redness at temperatures from above 300° C. to about 800° C. Very effective temperatures are in a range from 450° to 700° C.

It shows now that at the same withdrawal speed of 3000 m/min and with a radiation toward the spinneret by means of the heated element, a substantial increase in the elongation at break will occur and, as a result, likewise an increase in the stretchability of the yarn. With a radiation of the element heated to 550° C., it was possible to increase in the example the elongation at break by 5%. Thus, a withdrawal speed of 3000 m/min resulted in a take-up speed likewise increased by 5%, namely of 5040 m/min. In the production of the initially indicated yarn denier, this increased take-up speed requires an increase of the melt delivery by discharge pump 9 to 84 g/min. As a result, the productivity of the system can be increased by 5%, by the simple measure of radiating heat toward the spinneret.

Figure 23:
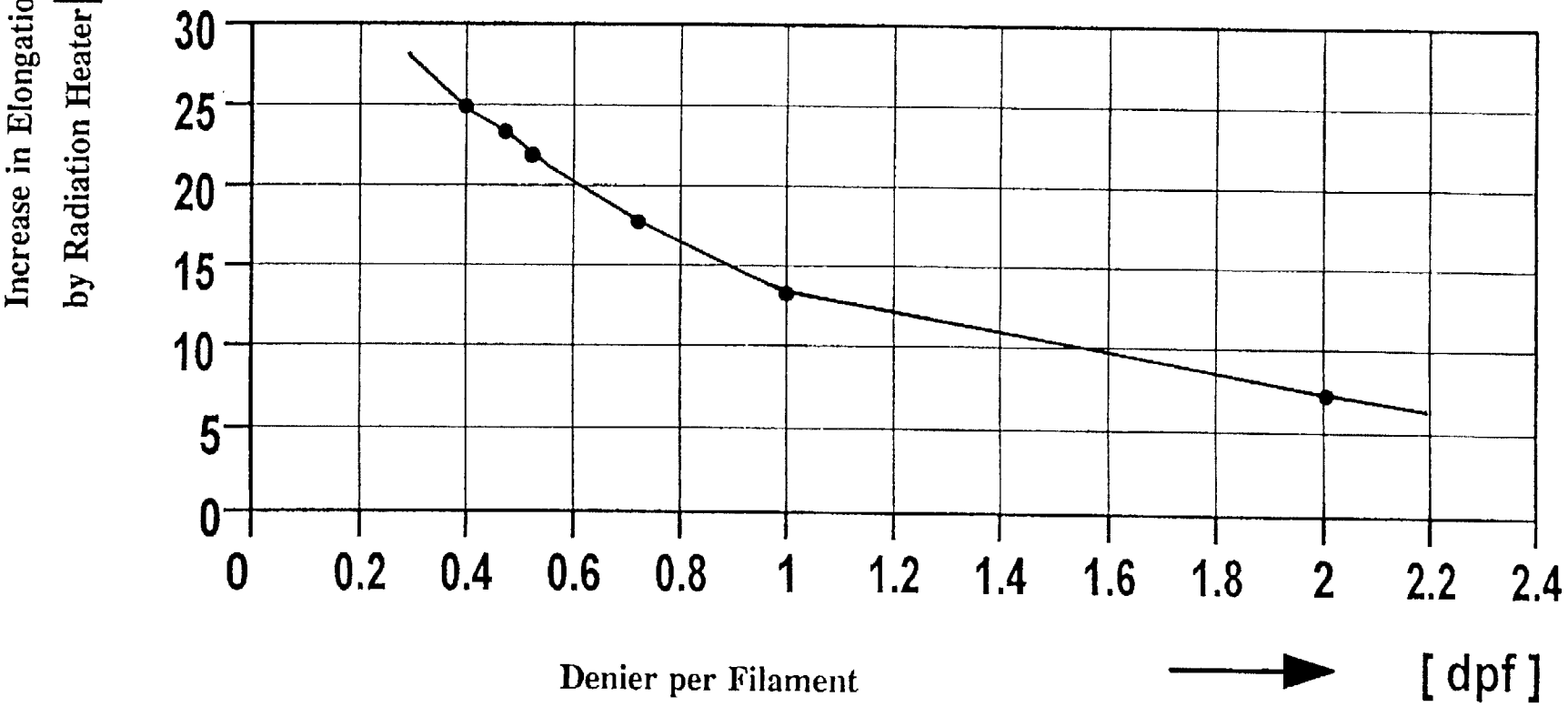
FIG. 23 is a diagram illustrating the dependence of the increase in elongation at break on the total denier of the produced yarn with a predetermined supply of heat to the spinneret.

As shown in the diagram of FIG. 23, the extent of the increased productivity is dependent, on the one hand, on the radiation temperature, and on the other hand on the yarn denier. At higher yarn deniers, the effect is less, or it will be necessary to select a higher radiation temperature. In the individual case, the correlation is to be determined by test.

The procedure in the method shown in FIGS. 2–3 is as follows:

For example, a 55 f 109 textured yarn, namely a yarn having 55 denier and 109 individual filaments is to be produced. This means that each yarn has 0.5 denier per filament (DPF). A draw ratio of 1.6 is determined to be optimal for the draw texturing process. This draw ratio permits a good crimping and a reliable texturing process without filament breakages. This draw ratio means that a partially oriented yarn having a denier of 88 and 109 filaments is to be supplied from feed yarn package 33. To partially orient such a yarn, so as to be able to maintain the draw ratio of 1.6, it will be necessary to adjust a ½ to ⅓ higher elongation at break. At a draw ratio of 1.6, the elongation at break must be 220%. From the diagram of FIG. 22 or the Table, the corresponding withdrawal speed is 2600 m/min, which must be adjusted in a method according to FIG. 2 at draw rolls 16. To produce an 88-denier, partially oriented yarn at 2600 m/min, it is necessary to adjust the melt delivery of the pump to 25.5 g/min for each spinning position. An increase in the melt delivery is not possible, since it will change likewise the withdrawal speed and, thus, the draw ratio. Thus, the draw ratio that is predetermined by the texturer or throwster, limits the productivity of the producer of the partially oriented yarn.

However, it is a different matter, when a tubular cooler of FIG. 6 or FIG. 7 is used. At the same draw ratio, it is possible to achieve an increase in the withdrawal speed by 20%, namely to 3360 m/min, in that heat is radiated toward the spinneret, with the element having a temperature of approximately 550° C. The melt delivery is to be increased accordingly to 32.9 m/min. As a result, productivity is increased by more than 20% with an otherwise unchanged machine layout.

Alternatively, a textured yarn of 55 denier and 109 filaments is to be produced, however, without exceeding in the take-up zone the withdrawal speed and the take-up speed of 3000 m/min. The reason for such limitations lies in occasional process problems with sensitive yarns. Such problems may however be caused by the mechanical layout of the take-up machine, whose maximum speed is limited.

Figure 22:
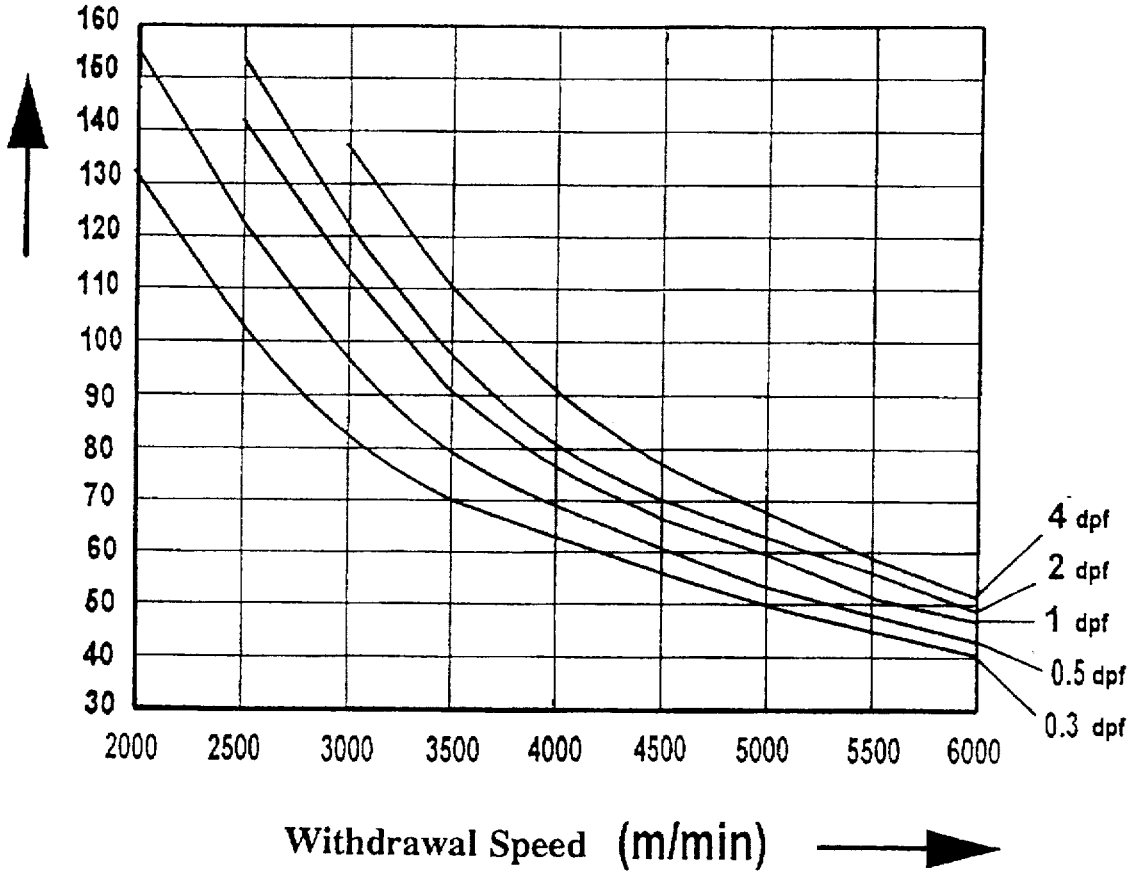
FIG. 22 is a diagram illustrating the relationship between withdrawal speed and elongation at break for partially oriented polyester filaments with different filament deniers.

As can be noted from or the diagram of FIG. 22, this yarn has an elongation at break of 96%. Therefore, the draw ratio to be selected in the draw zone is about two thirds of the breaking length of 196%. Selected is a draw ratio of 1.3:1. It results therefrom that the denier of the partially oriented yarn, that is supplied as feed yarn in the draw texturing process, must amount to 55 dtex×1.3=71.5. From this, it results again that this yarn is produced in the spin zone with a melt delivery of 71.5 g: 9000 m×3000 m/min=23.8 g/min per spinning position.

When a tubular cooler of FIG. 6 or FIG. 7 is now used again, and the first element is heated to a temperature of 550° C., a 20% increased elongation at break of 96%×120%=115% is obtained at a withdrawal speed of 3000 m/min, namely a breaking length of 215%. Thus, in the subsequent draw zone, it is possible to adjust the draw ratio at about two thirds of this value, i.e. to 1.45. This again means that to produce a total denier of 55 denier, it is necessary to supply as feed yarn a partially oriented yarn with a denier of 55×1.45=79 denier. To produce a 79 denier yarn at a withdrawal speed of 3000 m/min, it is necessary to adjust the melt delivery to 26.3 g/min per spinning position. As a result, the productivity in the spinning phase can be increased by 26.3–23.8:23.8.

It should be remarked that individual values forming the basis for the preceding calculation and examples were determined for a certain polymer (polyester). As a function of origin and the kind of polymer in use, deviations may result for the individual values, which are to be determined by test. This applies on the one hand to the determined elongations at break, the dependence of the draw ratio on the determined elongation at break, the correlation of radiation temperature and increase in the elongation at break, and likewise to the denier-related increase in productivity.

Thus, the characteristic feature consists in that the melt is heated in the spinneret. To this end the spinneret is heated in addition to the heat, which it receives from the melt, the surrounding spin pack, and the surrounding spin box. Preferably, the temperature of the spinneret is increased by at least 5° C. to 40° C. In tests, increases in the temperature by 8° to 20° C. have shown to be advantageous. The basis to proceed from is always the temperature that surrounds the heated spin box. Normally, at a relatively low temperature of the spinneret, the heating must accordingly be greater by an additional supply of heat.

Compensated for are not only losses in heat radiation on the underside of the spinneret, but also an additional increase in temperature occurs. Whereas in a conventional process, temperatures of about 290° C. were measured on the underside of the spinneret, a radiation from a radiator heated to 550° C. resulted in an increased temperature of 310° C.

That which is claimed is:

1. A cooling tube for cooling synthetic filaments as they advance downwardly from a spinneret of a melt spinning machine, comprising a generally tubular wall which defines a central axis and along which the synthetic filaments are adapted to advance in an axial direction, with said wall comprising a plurality of superposed annular elements which coaxially overlie each other in a spaced apart arrangement and so as to define an annular gas channel between each adjacent pair of annular elements.

2. A cooling tube as in claim 1 wherein each pair of adjacent annular elements defines opposing flat surfaces which are parallel to each other.

3. A cooling tube as in claim 2 wherein the opposing flat surfaces are horizontal and perpendicular to said central axis.

4. A cooling tube as in claim 2 wherein the opposing flat surfaces are inclined with respect to said central axis.

5. A cooling tube as in claim 1 wherein each pair of adjacent annular elements defines opposing convexly curved surfaces.

6. A cooling tube as in claim 1 wherein each pair of adjacent annular elements defines opposing flat surfaces which are angularly disposed with respect to each other.

7. A cooling tube as in claim 1 further comprising a pressure container substantially enclosing said tubular wall, and a source of compressed air connected to said pressure container.

8. A cooling tube as in claim 1 further comprising spacers positioned between and connecting adjacent annular elements.

9. A cooling tube as in claim 8 wherein said spacers of each pair of adjacent annular elements are circumferentially offset from the spacers of each adjacent pair of adjacent annular elements.

10. A cooling tube as in claim 1 wherein the annular elements have diameters which respectively diminish in the direction of the central axis and such that the tubular wall has a conical configuration.

11. A cooling tube as in claim 1 wherein at least one of said annular elements is electrically heated.

12. A cooling tube as in claim 1 wherein said tubular wall has an axial length of between about 540 to 1650 mm.

13. A cooling tube as in claim 1 wherein said annular elements are spaced apart a distance between about 0.5 to 3 mm.

14. A cooling tube as in claim 1 wherein each said annular elements has an axial thickness which is greater than the axial dimension of each of the annular gas channels.

15. A melt spinning apparatus for extruding and spinning a synthetic material to form a plurality of filaments, comprising melt spinning means including a spinning nozzle for continuously extruding a plurality of synthetic filaments downwardly through the spinning nozzle, and a cooling tube disposed below said spinning nozzle, said cooling tube comprising a generally tubular wall which defines a central axis and along which the synthetic filaments advance in an axial direction from said spinning nozzle, with said wall comprising a plurality of superposed annular elements which coaxially overlie each other in a spaced apart arrangement and so as to define an annular gas channel between each adjacent pair of annular elements.

16. A melt spinning apparatus as defined in claim 15 wherein the cooling tube is positioned so that the extruded filaments advance through the inside of the cooling tube.

17. A melt spinning apparatus as defined in claim 15 wherein the cooling tube has a conical configuration with the largest diameter thereof positioned adjacent said spinning nozzle, and wherein the spinning nozzle is configured so as to extrude a tubular array of synthetic filaments which is disposed coaxially on the outside of said cooling tube.

18. A melt spinning apparatus as defined in claim 17 further comprising means for guiding the tubular array of filaments in a converging generally conical arrangement which generally conforms to the conical configuration of the cooling tube, and a source of pressurized air which is connected to an outlet positioned within the cooling tube and so that the air passes outwardly through said annular gas channels and into contact with the advancing filaments.

19. A melt spinning apparatus as in claim 15 wherein each pair of adjacent annular elements defines opposing flat surfaces which are parallel to each other and inclined with respect to the central axis so as to define a conical surface segment having an apex.

20. A melt spinning apparatus as in claim 19 wherein each apex is directed oppositely to the advancing direction of the filaments.

21. A melt spinning apparatus as in claim 19 wherein each apex is directed in the advancing direction of the filaments.

22. A melt spinning apparatus as in claim 15 wherein each of said annular elements has an axial thickness which is greater than the axial dimension of each of the annular gas channels.

23. A melt spinning apparatus as in claim 15 wherein the axial spacing between adjacent annular elements varies along the axial length of the cooling tube.

* * * * *

UNITED STATES PATENT AND TRADEMARK OFFICE

CERTIFICATE OF CORRECTION

PATENT NO. : 5,700,490
DATED : December 23, 1997
INVENTOR(S) : Meise

It is certified that error appears in the above-identified patent and that said Letters Patent is hereby corrected as shown below:

Column 2, line 25, after flow, "Conditions" should be --conditions--.

That portion of the specification appearing between column 5, line 15 and column 5, line 48, should be moved to after the period in column 4, line 48.

Column 15, line 6, delete "are adapted to".

Signed and Sealed this

Seventeenth Day of November, 1998

*Attest:*

*Attesting Officer*

BRUCE LEHMAN

*Commissioner of Patents and Trademarks*